US007736466B2

(12) United States Patent
Singh et al.

(10) Patent No.: US 7,736,466 B2
(45) Date of Patent: Jun. 15, 2010

(54) PAPER SUBSTRATES CONTAINING HIGH SURFACE SIZING AND LOW INTERNAL SIZING AND HAVING HIGH DIMENSIONAL STABILITY

(75) Inventors: Kapil Mohan Singh, Loveland, OH (US); Dennis W. Anderson, Goshen, OH (US); Peter M Froass, Mason, OH (US); Yaoliang Hong, Mason, OH (US); Krishna K Mohan, Mason, OH (US); Thomas R Arnson, Loveland, OH (US); Yan C Huang, Williamsburg, OH (US)

(73) Assignee: International Paper Company, Memphis, TN (US)

( * ) Notice: Subject to any disclaimer, the term of this patent is extended or adjusted under 35 U.S.C. 154(b) by 452 days.

(21) Appl. No.: 11/655,004

(22) Filed: Jan. 17, 2007

(65) Prior Publication Data

US 2008/0035292 A1 Feb. 14, 2008

Related U.S. Application Data

(60) Provisional application No. 60/759,629, filed on Jan. 17, 2006, provisional application No. 60/759,630, filed on Jan. 17, 2006, provisional application No. 60/853,882, filed on Oct. 24, 2006.

(51) Int. Cl.
*D21H 11/00* (2006.01)

(52) U.S. Cl. ..... 162/175; 162/158; 162/168.3; 162/164.6; 162/177

(58) Field of Classification Search ..... 162/175, 162/158, 168.3, 164.6, 177
See application file for complete search history.

(56) References Cited

U.S. PATENT DOCUMENTS

| | | | |
|---|---|---|---|
| 2,322,888 | A | 6/1943 | Schwartz |
| 3,615,972 | A | 10/1971 | Morehouse et al. |
| 3,864,181 | A | 2/1975 | Wolinski et al. |
| 4,006,273 | A | 2/1977 | Wolinski et al. |
| 4,022,965 | A | 5/1977 | Goheen et al. |
| 4,044,176 | A | 8/1977 | Wolinski et al. |
| 4,075,136 | A | 2/1978 | Schaper |
| 4,166,894 | A | 9/1979 | Schaper |
| 4,174,417 | A | 11/1979 | Rydell |
| 4,289,808 | A | 9/1981 | Huang |
| 4,431,481 | A | 2/1984 | Drach et al. |
| 4,496,427 | A | 1/1985 | Davison |
| 4,722,943 | A | 2/1988 | Melber et al. |
| 4,829,094 | A | 5/1989 | Melber et al. |
| 4,986,882 | A | 1/1991 | Mackey et al. |
| 5,049,235 | A | 9/1991 | Barcus et al. |
| 5,160,789 | A | 11/1992 | Barcus et al. |
| 5,209,953 | A | 5/1993 | Grupe et al. |
| 5,266,250 | A | 11/1993 | Kroyer |
| 5,360,420 | A | 11/1994 | Cook et al. |
| 5,443,899 | A | 8/1995 | Barcus et al. |
| 5,531,728 | A | 7/1996 | Lash |
| 5,662,773 | A | 9/1997 | Scheiter et al. |
| 5,667,637 | A | 9/1997 | Jewell et al. |
| 5,698,074 | A | 12/1997 | Barcus et al. |
| 5,698,688 | A | 12/1997 | Smith et al. |
| 5,731,080 | A | 3/1998 | Cousin et al. |
| 5,792,317 | A | 8/1998 | Taylor et al. |
| 5,858,076 | A | 1/1999 | Thompson |
| 5,985,030 | A | 11/1999 | Taylor et al. |
| 5,997,692 | A | 12/1999 | Taylor et al. |
| 6,146,494 | A | 11/2000 | Seger et al. |
| 6,361,651 | B1 | 3/2002 | Sun |
| 6,372,361 | B1 | 4/2002 | Mackewicz et al. |
| 6,379,497 | B1 | 4/2002 | Sandstrom et al. |
| 6,471,824 | B1 | 10/2002 | Jewell |
| 6,506,282 | B2 | 1/2003 | Hu et al. |
| 6,521,088 | B1 | 2/2003 | Richardson et al. |
| 6,579,414 | B2 | 6/2003 | Jewell |
| 6,579,415 | B2 | 6/2003 | Jewell |
| 6,582,557 | B2 | 6/2003 | Jewell |
| 6,592,712 | B2 | 7/2003 | Koukoulas et al. |
| 6,592,717 | B2 | 7/2003 | Jewell |
| 6,617,364 | B2 | 9/2003 | Soane et al. |
| 6,893,473 | B2 | 5/2005 | Neogi et al. |
| 7,214,728 | B2 | 5/2007 | Kimpimaki et al. |
| 7,429,309 | B2 | 9/2008 | Propst, Jr. et al. |
| 2001/0044477 | A1 | 11/2001 | Soane et al. |
| 2003/0008931 | A1 | 1/2003 | Soane et al. |
| 2003/0008932 | A1 | 1/2003 | Soane et al. |

(Continued)

FOREIGN PATENT DOCUMENTS

| | | |
|---|---|---|
| GB | 551950 | 3/1943 |
| WO | 2005/024131 A1 | 3/2005 |
| WO | 2005024131 A1 | 3/2005 |
| WO | WO2006/086736 | 8/2006 |
| WO | WO2006/099364 | 9/2006 |
| WO | WO2007/008786 | 1/2007 |
| WO | WO2007/053681 | 5/2007 |

OTHER PUBLICATIONS

John Considine and John Bobalek, In-Plane Hydroexpansivity of Postage Stamp Papers, 1992 Proceedings TAGA 43d annual technical conference, pp. 283-295.*

Handbook for pulp and paper technologists, G.A. Smook (1992), Angus Wilde Publications.

*Primary Examiner*—Mark Halpern
(74) *Attorney, Agent, or Firm*—Thomas W. Barnes, III; Richard C. Stewart, II; John K. Pike

(57) ABSTRACT

This invention relates to a paper substrate containing high surface sizing and low internal sizing and having high dimensional stability, as well as methods of making and using the composition.

21 Claims, 12 Drawing Sheets

U.S. PATENT DOCUMENTS

| | | | |
|---|---|---|---|
| 2003/0173045 | A1 | 9/2003 | Confalone et al. |
| 2004/0065423 | A1 | 4/2004 | Swerin et al. |
| 2004/0123966 | A1 | 7/2004 | Altman et al. |
| 2004/0157057 | A1 | 8/2004 | Tasaki et al. |
| 2004/0221976 | A1 | 11/2004 | Williams |
| 2006/0102307 | A1 | 5/2006 | Kron et al. |
| 2006/0124263 | A1 | 6/2006 | Lipponen et al. |
| 2006/0191656 | A1* | 8/2006 | Buzza et al. ..... 162/158 |
| 2008/0206571 | A1 | 8/2008 | Berckmans et al. |
| 2009/0017235 | A1 | 1/2009 | Bays et al. |

* cited by examiner

JUICE CARTON (AFTER THRESHOLDING )

C1S BOARD ( NORMALIZED GRAY SCALE )

COPY PAPER ( AS CAPTURED )

PRESENT INVENTION MEAN AND COMPOSITE WITH BASELINE

PRESENT INVENTION AREA OF INTEREST FOR CALCULATIONS

CONVENTIONAL PAPER SUBSTRATE MEAN AND COMPOSITE FIGURE WITH BASELINE

5L0309 (10x OBJECTIVE )

5L0309 ( 20x OBJECTIVE )

5L0310 ( 10x OBJECTIVE )

5L0310 ( 20x OBJECTIVE )

5L0311 ( 10x OBJECTIVE )

5L0311 ( 20x OBJECTIVE )

SOLID LINES: 1st CONTROL ( 5L0305 )
DASHED LINES:2nd CONTROL ( 5L0309 )
ALL CHANGES ARE w.r.t. INITIAL LENGTH ( AT 50% RH )

SOLID LINES: 6 lb/T BULKING PARTICLE
DASHED LINES:2nd CONTROL ( 5L0309 )
ALL CHANGES ARE w.r.t. INITIAL LENGTH ( AT 50% RH )

SOLID LINES: 12 lb/T AT 125 PLI BULKING PARTICLE
DASHED LINES:12 lb/T AT 200 PLI BULKING PARTICLE
ALL CHANGES ARE w.r.t. INITIAL LENGTH ( AT 50% RH )

PAPER SUBSTRATES CONTAINING HIGH SURFACE SIZING AND LOW INTERNAL SIZING AND HAVING HIGH DIMENSIONAL STABILITY

The present application claims the benefit of priority under 35 USC §119(e) to U.S. Provisional Patent Application 60/759,629, entitled "PAPER SUBSTRATES CONTAINING HIGH SURFACE SIZING AND LOW INTERNAL SIZING AND HAVING HIGH DIMENSIONAL STABILITY", filed Jan. 17, 2006, which is hereby incorporated, in its entirety, herein by reference. The present application claims the benefit of priority under 35 USC §119(e) to U.S. Provisional Patent Application 60/853,882, entitled "PAPER SUBSTRATES CONTAINING HIGH SURFACE SIZING AND LOW INTERNAL SIZING AND HAVING HIGH DIMENSIONAL STABILITY", filed Oct. 24, 2006, which is hereby incorporated, in its entirety, herein by reference. The present application claims the benefit of priority under 35 USC §119 (e) to U.S. Provisional Patent Application 60/759,630, entitled "PAPER SUBSTRATES CONTAINING A BULKING AGENT, HIGH SURFACE SIZING, LOW INTERNAL SIZING AND HAVING HIGH DIMENSIONAL STABILITY", filed Jan. 17, 2006, which is hereby incorporated, in its entirety, herein by reference.

FIELD OF THE INVENTION

This invention relates to a paper substrate containing high surface sizing and low internal sizing and having high dimensional stability, as well as methods of making and using the composition.

BACKGROUND OF THE INVENTION

The performance variables of paper substrates vary greatly themselves depending upon the vast array of end-uses for such substrates. However, most performance variables may be programmed in a paper more readily as the dimensional stability of the substrate increases. Therefore, for a very long time, it has been desired in the market to supply a dynamic paper substate having superior dimensional stability, yet being capable of having high surface strength.

Lipponen et al. (2003) "Surface sizing with starch solutions at high solids content", TAPPI Metered Size Press Forum, discusses the use of size-press applied high starch solution solids that may be used to gain surface strength in some very select cases, but fail to achieve and/or appreciate the importance of a dimensionally stable paper substrate. Further, the papers described in Lipponen et al., have what the authors describe as undesirable low internal strength (not lower than about 140 J/m$^2$).

In addition, a subsequent paper by Lipponen et al. (2005) "Effect of press draw and basis weight on woodfree paper properties during his solids surface sizing", TAPPI Spring Technical Conference & Trade Fair, the authors discuss methodologies for increasing the undesirably low internal strength of a paper substrate containing size-press applied high starch solution solids thereon. Unfortunately, these references are representative of failing attempts to provide a paper substrate having high dimensional stability and high surface strength all at once.

Accordingly, there is still a need for a low cost and efficient solution to increase dimensional stability and surface strength of a paper substrate.

DETAILED DESCRIPTION

Figure 1:
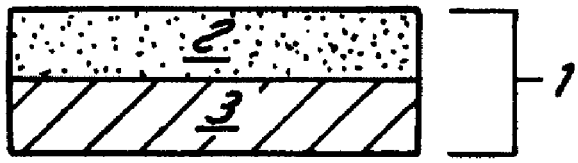
FIG. 1 represents one embodiment of the paper substrate of the present invention.

The present inventors have now discovered a low cost and efficient solution to increase dimensional stability and surface strength of a paper substrate.

One aspect of the present invention relates to a paper substrate.

The paper substrate of the present invention contains a web of cellulose fibers. The paper substrate of the present invention may contain recycled fibers and/or virgin fibers. One exemplified difference between recycled fibers and virgin fibers is that recycled fibers may have gone through the drying process at least once.

The paper substrate of the present invention may contain from 1 to 99 wt %, preferably from 5 to 95 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood.

The paper substrate of the present invention may contain from 1 to 100 wt %, preferably from 10 to 60 wt %, cellulose fibers originating from softwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate may alternatively or overlappingly contain from 0.01 to 99 wt % fibers from softwood species most preferably from 10 to 60 wt % based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 99 wt % softwood based upon the total weight of the paper substrate, including any and all ranges and subranges therein.

The paper substrate may contain softwood fibers from softwood species that have a Canadian Standard Freeness (csf) of from 300 to 750, more preferably from 400 to 550. This range includes 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 csf, including any and all ranges and subranges therein. Canadian Standard Freeness is as measured by TAPPI T-227 standard test.

The paper substrate of the present invention may contain from 1 to 100 wt %, preferably from 30 to 90 wt %, cellulose fibers originating from hardwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate may alternatively or overlappingly contain from 0.01 to 99 wt % fibers from hardwood species, preferably from 60 to 90 wt % based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95, 99 and 99 wt % fines based upon the total weight of the paper substrate, including any and all ranges and subranges therein.

The paper substrate may contain fibers from hardwood species that have a Canadian Standard Freeness (csf) of from 300 to 750, more preferably from 400 to 550 csf. This range includes 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 csf, including any and all ranges and subranges therein. Canadian Standard Freeness is as measured by TAPPI T-227 standard test.

In one embodiment, the paper substrate contains fibers, either softwood and/or hardwood, that is less refined. The paper substrate contains these fibers that are at least 2% less refined compared to conventional paper substrates, preferably at least 5% less refined, more preferably 10% less refined, most preferably at least 15% less refined, than that of fibers used in conventional paper substrates. For example, if a conventional paper contains fibers, softwood and/or hardwood, having a Canadian Standard Freeness (CSF) that is 350, then the paper substrate of the present invention would more preferably contain fibers having a CSF of 385 (i.e. refined 10% less than conventional) and still performs similar, if not better, than the conventional paper. Some representative performance qualities of the substrate of the present invention are discussed below. Some reductions in refining of hardwood and/or softwood fibers that are representative of the present invention include, but are not limited to, 1) from 350 to at least 385 CSF; 2) from 350 to at least 400 CSF; 3) from 400 to at least 450 CSF; and 4) from 450 to at least 500 CSF. The reduction in fiber refinement may be at least 2, 3, 4, 5, 6, 7, 8, 9, 10, 11, 12, 13, 14, 15, 16, 17, 18, 19, 20, and 25% reduction in refining as compared to those fibers contained in conventional paper substrates, yet the present invention is able to perform equal to and/or better than the conventional paper substrates.

When the paper substrate contains both hardwood and softwood fibers, it is preferable that the hardwood/softwood ratio be from 0.001 to 1000, preferably from 90/10 to 30/60. This range may include 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000 including any and all ranges and subranges therein and well as any ranges and subranges therein the inverse of such ratios.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means including crosslinking and precipitation of complexes thereon. Examples of such modification of fibers may be, but is not limited to, those found in the following U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated, in their entirety, herein by reference. Further modification of fibers is found in U.S. Patent Application No. 60/654,712 filed Feb. 19, 2005, and U.S. patent application Ser. No. 11/358,543 filed Feb. 21, 2006, which may include the addition of optical brighteners (i.e. OBAs) as discussed therein, which is hereby incorporated, in its entirety, herein by reference.

Sources of "Fines" may be found in SaveAll fibers, recirculated streams, reject streams, waste fiber streams. The amount of "fines" present in the paper substrate can be modified by tailoring the rate at which such streams are added to the paper making process.

The paper substate may contain a combination of hardwood fibers, softwood fibers and "fines" fibers. "Fines" fibers are, as discussed above, recirculated and are typically not more that 100 μm in length on average, preferably not more than 90 μm, more preferably not more than 80 μm in length, and most preferably not more than 75 μm in length. The length of the fines are preferably not more than 5, 10, 15, 20, 25, 30, 35, 40, 45, 50, 55, 60, 65, 70, 75, 80, 85, 90, 95, and 100 μm in length, including any and all ranges and subranges therein.

The paper substrate contains from 0.01 to 100 wt % fines, preferably from 0.01 to 50 wt %, most preferably from 0.01 to 15 wt % based upon the total weight of the substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the paper, including any and all ranges and subranges therein.

The paper substrate may alternatively or overlappingly contain from 0.01 to 100 wt % fines, preferably from 0.01 to 50 wt %, most preferably from 0.01 to 15 wt % based upon the total weight of the fibers contained by the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the fibers contained by the paper substrate, including any and all ranges and subranges therein.

The paper substrate contains at least one sizing agent. A sizing agent is the substance added to a paper to make it moisture or water-resistant in varying degrees. Examples of sizing agents can be found in the "Handbook for pulp and paper technologists" by G. A. Smook (1992), Angus Wilde Publications, which is hereby incorporated, in its entirety, by reference. Preferably, the sizing agent is a surface sizing agent. Preferable examples of sizing agents are starch and polyvinyl alcohol (PVOH), as well as polyvinylamine, alginate, carboxymethyl cellulose, etc. However, any sizing agent may be used.

When starch is used as a sizing agent, starch may be modified or unmodified. Examples of starch is found in the "Handbook for pulp and paper technologists" by G. A. Smook (1992), Angus Wilde Publications, mentioned above. Preferable examples of modified starches include, for example, oxidized, cationic, ethylated, hydroethoxylated, etc. In addition, the starch may come from any source, preferably potato and/or corn. Most preferably, the starch source is corn.

When polyvinyl alcohol is used as a sizing agent, it may have any % hydrolysis. Preferable polyvinyl alcohols are those having a % hydrolysis ranging from 100% to 75%. The % hydrolysis of the polyvinyl alcohol may be 75, 76, 78, 80, 82, 84, 85, 86, 88, 90, 92, 94, 95, 96, 98, and 100% hydrolysis, including any and all ranges and subranges therein.

The paper substrate of the present invention may then contain PVOH at any wt %. Preferably, when PVOH is present, it is present at an amount from 0.001 wt % to 100 wt % based on the total weight of sizing agent contained in and/or on the substrate. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, 20, 25, 30, 35, 40, 45, 50, 55, 60, 65, 70, 75, 80, 85, 90, 95, and 100 wt % based on the total weight of sizing agent in the substrate, including any and all ranges and subranges therein.

The paper substrate of the present invention may contain the sizing agent at any amount. Preferably, the paper substrate of the present invention may contain from 0.01 to 20 wt % of at least one sizing agent, more preferably from 1 to 10 wt % sizing agent, most preferably from 2 to 8 wt % sizing agent based upon the total weight of the substrate. This range includes 0.01, 0.05, 0.1, 0.2, 0.5, 1, 2, 3, 4, 5, 6, 7, 8, 9, 10, 11, 12, 13, 14, 15, 16, 17, 18, 19 and 20 wt % sizing agent based upon the total weight of the substrate, including any and all ranges and subranges therein.

In a preferred embodiment of the present invention, the sizing agent may be at least one surface sizing agent. However, the surface sizing agent may be used in combination with at least one internal sizing agent. Examples of surface and internal sizing agents can be found in the "Handbook for pulp and paper technologists" by G. A. Smook (1992), Angus Wilde Publications, which is hereby incorporated, in its entirety, by reference. In some instances, the surface and internal sizing agent may be identical.

When the paper substrate contains both internal and surface sizing agents, they may be present at any ratio and they may be the same and/or different sizing agents. Preferably, the ratio of surface sizing agent to internal sizing agent is from 50/50 to 100/0, more preferably from 75/25 to 100/0 surface/internal sizing agent. This range includes 50/50, 55/45, 60/40, 65/35, 70/30, 75/25, 80/20, 85/15, 90/10, 95/5 and 100/0, including any and all ranges and subranges therein.

The paper substrate contains at least one sizing agent. However, at least a majority of the total amount of sizing agent is preferably located at the outside surface of the substrate. The paper substrate of the present invention may contain the sizing agent within a size press applied coating layer. The size press applied coating layer may or may not interpenetrate the cellulose fibers of the substrate. However, if the coating layer and the cellulose fibers interpenetrate, it will create a paper substrate having an interpenetration layer.

Figure 2:
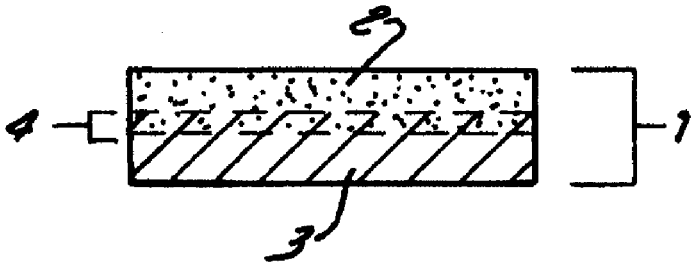
FIG. 2 represents one embodiment of the paper substrate of the present invention.
Figure 3:
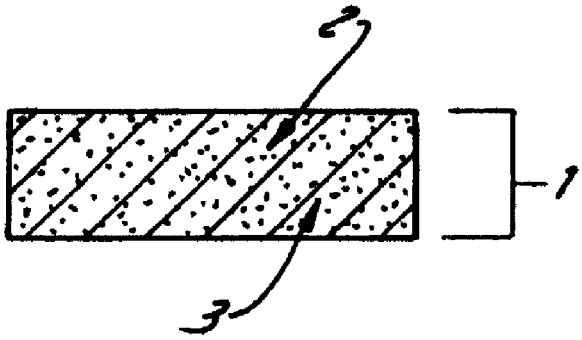
FIG. 3 represents one embodiment of the paper substrate of the present invention.

FIGS. 1-3 demonstrate different embodiments of the paper substrate 1 in the paper substrate of the present invention. FIG. 1 demonstrates a paper substrate 1 that has a web of cellulose fibers 3 and a sizing composition 2 where the sizing composition 2 has minimal interpenetration of the web of cellulose fibers 3. Such an embodiment may be made, for example, when a sizing composition is coated onto a web of cellulose fibers.

FIG. 2 demonstrates a paper substrate 1 that has a web of cellulose fibers 3 and a sizing composition 2 where the sizing composition 2 interpenetrates the web of cellulose fibers 3. The interpenetration layer 4 of the paper substrate 1 defines a region in which at least the sizing solution penetrates into and is among the cellulose fibers. The interpenetration layer may be from 1 to 99% of the entire cross section of at least a portion of the paper substrate, including 1, 2, 5, 10, 15, 20, 25, 30, 35, 40, 45, 50, 55, 60, 65, 70, 75, 80, 85, 90, 95, and 99% of the paper substrate, including any and all ranges and subranges therein. Such an embodiment may be made, for example, when a sizing solution is added to the cellulose fibers prior to a coating method and may be combined with a subsequent coating method if required. Addition points may be at the size press, for example.

FIG. 3 demonstrates a paper substrate 1 that has a web of cellulose fibers 3 and a sizing solution 2 where the sizing solution 2 is approximately evenly distributed throughout the web of cellulose fibers 3. Such an embodiment may be made, for example, when a sizing solution is added to the cellulose fibers prior to a coating method and may be combined with a subsequent coating method if required. Exemplified addition points may be at the wet end of the paper making process, the thin stock, and the thick stock.

Preferably, the interpenetration layer 4 is minimized and/or the concentration of the sizing agent is preferably increasing towards the surface of the paper substrate. Therefore, the amount of sizing agent present towards the top and/or bottom outer surfaces of the substrate is preferably greater than the amount of sizing agent present towards the inner middle of paper substrate. Alternatively, a majority percentage of the sizing agent may preferably be located at a distance from the outside surface of the substrate that is equal to or less than 25%, more preferably 10%, of the total thickness of the substrate. This aspect may also be known as the $Q_{total}$ which is measured by known methodologies outlined in the Examples below using starch as an example. If $Q_{total}$ is equal to 0.5, then the sizing agent is approximately evenly distributed throughout the paper substrate. If $Q_{total}$ is greater than 0.5, then there is more sizing agent towards the inner middle of the paper substrate than towards the paper substrate's surfaces. If $Q_{total}$ is less than 0.5, then there is less sizing agent towards the inner middle of the paper substrate than towards the paper substrate's surfaces. In light of the above, the paper substrate of the present invention preferably has a $Q_{total}$ that is less than 0.5, preferably less than 0.4, more preferably less than 0.3, most preferably less than 0.25. Accordingly the $Q_{total}$ of the paper substrate of the present invention may be from 0 to less than 0.5. This range includes 0, 0.001, 0.002, 0.005, 0.01, 0.02, 0.05, 0.1, 0.15, 0.2, 0.25, 0.3, 0.35, 0.4, 0.45, and 0.49, including any and all ranges and subranges therein.

In essence, Q is a measurement of the amount of the starch as one progresses from the outside edges towards the middle of the sheet from a cross section view. It is understood herein that the Q may be any Q such that it represents an enhanced capacity to have starch towards the outside surfaces of the cross section of the sheet and Q may be selected (using any test) such that any one or more of the above and below-mentioned characteristics of the paper substrate of the present invention are provided (e.g. Internal Bond, Hygroexpansivity, IGT Pick, and/or IGT VPP delamination, etc).

Of course, there are other methods to measuring the equivalent of Q, mentioned above. The spirit of the present invention is thus such that any Q measurement, or a similar method of measuring the ratio of the amount of sizing agent towards the core of the substrate compared to the amount of sizing agent towards the outside surfaces of the substrate is acceptable. In a preferred embodiment, this ratio is such that as much sizing agent as possible is located towards the outside surfaces of the substrate, thereby minimizing the interpenetration zone and/or minimizing the amount of starch located in the interpenetration layer, is achieved. It is also preferable that this distribution of sizing agent occurs even at very high level of sizing agent loadings, preferably external sizing agent loadings, within and/or onto the substrate. Thus, one object of the present invention is to tightly control the amount of sizing agent located within the interpenetration layer as more and more external sizing agent is loaded thereon its surface by either minimizing the concentration of the sizing agent in this interpenetration layer or by reducing the thickness of the interpenetration layer itself. The below characteristics of the paper substrate of the present invention are those that can be achieved by such control of the sizing agent. While this controlled loading of the sizing agent can occur in any manner, it is discussed below that the sizing agent is preferably loaded via a size press.

The paper substrate preferably has high dimensional stability. Paper substrates having high dimensional stability preferably have a diminished tendency to curling. Therefore, preferable paper substrates of the present invention have reduced tendency to curl as compared to conventional paper substrates.

One very good indicator of dimensional stability is the physical measurement of hygroexpansivity, preferably, Neenah hygroexpansion using TAPPI USEFUL METHOD 549 by electronic monitoring and control of Relative Humidity (RH) using a desiccator and humidifier rather than simply salt concentration. The RH of the surrounding environment is changed from 50% to 15% then to 85%, causing dimensional changes in the paper sample that are measured. For example, the paper substrate of the present invention has a hygroexpansivity in the CD direction when changing the RH as indicated above of from 0.1 to 1.9%, preferably from 0.7 to 1.2%, most preferably from 0.8 to 1.0%. This range includes 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, and 1.9%, including any and all ranges and subranges therein.

The paper substrate preferably has a MD internal bond of from 10 to 350 ft-lbs$\times10^{-3}$/in$^2$, preferably from 75 to 120 ft-lbs$\times10^{-3}$/in$^2$, more preferably from 80 to 100 ft-lbs$\times10^{-3}$/in$^2$, most preferably from to 90 to 100 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The MD internal bond is Scott Bond as measured by test TAPPI t-569.

The paper substrate preferably has a CD internal bond of from 10 to 350 ft-lbs$\times10^{-3}$/in$^2$, preferably from 75 to 120 ft-lbs$\times10^{-3}$/in$^2$, more preferably from 80 to 100 ft-lbs$\times10^{-3}$/in$^2$, most preferably from to 90 to 100 ft-lbs$\times10^{-3}$/in$^2$. This range includes 10, 11, 12, 13, 14, 15, 20, 25, 30, 35, 40, 45, 50, 55, 60, 65, 70, 75, 80, 85, 90, 95, 100, 105, 110, 115, 120, 125, 130, 135, 140, 145, 150, 160, 165, 170, 175, 180, 185, 190, 195, 200, 210, 220, 230, 240, 250, 260, 270, 280, 290, 300, 310, 320, 330, 340, and 350 ft-lbs$\times10^{-3}$/in$^2$, including any and all ranges and subranges therein. The CD internal bond is Scott Bond as measured by test TAPPI t-569.

Both of the above-mentioned CD and MD internal bond as measured by Scott Bond test TAPPI t-569 may also be measured in $J/m^2$. The conversion factor to convert ft-lbs$\times 10^{-3}$/in$^2$ to $J/m^2$ is 2. Therefore, to convert an internal bond of 100 ft-lbs$\times 10^{-3}$/in$^2$ to $J/m^2$, simply multiply by 2 (i.e. 100 ft-lbs$\times 10^{-3}$/in$^2\times 2$ $J/m^2$/1 ft-lbs$\times 10^{-3}$/in$^2$=200 $J/m^2$. All of the above-mentioned ranges in ft-lbs$\times 10^{-3}$/in$^2$, therefore, may then include the corresponding ranges for internal bonds in $J/m^2$ as follows.

The paper substrate preferably has a MD internal bond of from 20 to 700 $J/m^2$, preferably from 150 to 240 $J/m^2$, more preferably from 160 to 200 $J/m^2$, most preferably from 180 to 200 $J/m^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 $J/m^2$, including any and all ranges and subranges therein. The MD internal bond is Scott Bond as measured by test TAPPI t-569.

The paper substrate preferably has a CD internal bond of from 20 to 700 $J/m^2$, preferably from 150 to 240 $J/m^2$, more preferably from 160 to 200 $J/m^2$, most preferably from 180 to 200 $J/m^2$. This range includes 20, 22, 24, 26, 28, 30, 40, 50, 60, 70, 80, 90, 100, 110, 120, 130, 140, 150, 160, 170, 180, 190, 200, 210, 220, 230, 240, 250, 260, 270, 280, 290, 300, 320, 330, 340, 350, 360, 370, 380, 390, 400, 420, 440, 460, 480, 500, 520, 540, 560, 580, 600, 620, 640, 660, 680, and 700 $J/m^2$, including any and all ranges and subranges therein. The CD internal bond is Scott Bond as measured by test TAPPI t-569.

The paper substate preferably has a Gurley porosity of from 5 to 100 seconds, preferably from 7 to 100 seconds, more preferably from 15 to 50 seconds, most preferably from 20 to 40 seconds. This range includes 5, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, and 40 seconds, including any and all ranges and subranges therein. The Gurley porosity is measured by test TAPPI t-536.

The paper substate preferably has a CD Gurley Stiffness of from 100 to 450 mgf, preferably 150 to 450 mgf, more preferably from 200 to 350 mgf. This range includes 100, 110, 120, 130, 140, 150, 160, 170, 180, 190, 200, 210, 220, 230, 240, 250, 260, 270, 280, 290, 300, 310, 320, 330, 340, 350, 375, 400, 425, and 450 mgf, including any and all ranges and subranges therein. The CD Gurley Stiffness is measured by test TAPPI t-543.

The paper substate preferably has a MD Gurley Stiffness of from 40 to 250 mgf, more preferably from 100 to 150 mgf. This range includes 40, 50, 60, 70, 80, 90, 100, 110, 120, 130, 140, 150, 160, 170, 180, 190, 200, 210, 220, 230, 240, and 250 mgf, including any and all ranges and subranges therein. The MD Gurley Stiffness is measured by test TAPPI t-543.

The paper substate preferably has an opacity of from 85 to 105%, more preferably from 90 to 97%. This range includes 85, 86, 87, 88, 89, 90, 91, 92, 93, 94, 95, 96, 97, 98, 99, 100, 101, 102, 103, 104, and 105%, including any and all ranges and subranges therein. The opacity is measured by test TAPPI t-425.

The paper substrate of the present invention may have any CIE whiteness, but preferably has a CIE whiteness of greater than 70, more preferably greater than 100, most preferably greater than 125 or even greater than 150. The CIE whiteness may be in the range of from 125 to 200, preferably from 130 to 200, most preferably from 150 to 200. The CIE whiteness range may be greater than or equal to 70, 80, 90, 100, 110, 120, 125, 130, 135, 140, 145, 150, 155, 160, 65, 170, 175, 180, 185, 190, 195, and 200 CIE whiteness points, including any and all ranges and subranges therein. Examples of measuring CIE whiteness and obtaining such whiteness in a papermaking fiber and paper made therefrom can be found, for example, in U.S. Pat. No. 6,893,473, which is hereby incorporated, in its entirety, herein by reference. Further, examples of measuring CIE whiteness and obtaining such whiteness in a papermaking fiber and paper made therefrom can be found, for example, in U.S. Patent Application No. 60/654,712 filed Feb. 19, 2005, entitled "Fixation of Optical Brightening Agents Onto Papermaking Fibers", and U.S. patent application Ser. Nos. 11/358,543 filed Feb. 21, 2006; 11/445,809 filed Jun. 2, 2006; and 11/446,421 filed Jun. 2, 2006, which are also hereby incorporated, in their entirety, herein by reference.

The paper substrate of the present invention may have any ISO brightness, but preferably greater than 80, more preferably greater than 90, most preferably greater than 95 ISO brightness points. The ISO brightness may be preferably from 80 to 100, more preferably from 90 to 100, most preferably from 95 to 100 ISO brightness points. This range include greater than or equal to 80, 85, 90, 91, 92, 93, 94, 95, 96, 97, 98, 99, and 100 ISO brightness points, including any and all ranges and subranges therein. Examples of measuring ISO brightness and obtaining such brightness in a papermaking fiber and paper made therefrom can be found, for example, in U.S. Pat. No. 6,893,473, which is hereby incorporated, in its entirety, herein by reference. Further, examples of measuring ISO brightness and obtaining such brightness in a papermaking fiber and paper made therefrom can be found, for example, in U.S. Patent Application No. 60/654,712 filed Feb. 19, 2005, entitled "Fixation of Optical Brightening Agents Onto Papermaking Fibers", and U.S. patent application Ser. No. 11/358,543 filed Feb. 21, 2006, which are also hereby incorporated, in their entirety, herein by reference.

The paper substrate of the present invention preferably has an improved print performance and improved runnability (e.g. print press performance). Print performance may be measured by determining improved ink density, dot gain, trapping, print contrast, and/or print hue, to name a few. Colors traditionally used in such performance tests include black, cyan, magenta and yellow, but are by no means limited thereto. Press performance may be determined by print contamination determinations through visual inspection of press systems, blankets, plates, ink system, etc. Contamination usually consists of fiber contamination, coating or sizing contamination, filler or binder contamination, piling, etc. The paper substrate of the present invention has an improved print performance and/or runnability as determined by each or any one or combination of the above attributes.

The paper substrate may have any surface strength. Examples of physical tests of a substrate's surface strength that also seem to correlate well with a substrate's print performance are the IGT pick tests and wax pick tests. Further, both tests are known in the art to correlate well with strong surface strength of paper substrates. While either of these tests may be utilized, IGT pick tests are preferred. IGT pick test is a standard test in which performance is measured by Tappi Test Method 575, which corresponds to the standard test ISO 3873.

The paper substrate may have at least one surface having a surface strength as measured by IGT pick test that is at least about 1, preferably at least about 1.2, more preferably at least about 1.4, most preferable at least about 1.8 m/s. The substrate has a surface strength as measured by IGT pick test that is at least about 2.5, 2.4, 2.3, 2.2, 2.1, 2.0, 1.9, 1.8, 1.7, 1.6, 1.5, 1.4, 1.3, 1.2, 1.1, and 1.0 m/s, including any and all ranges and subranges therein.

Another known related test is one that which measures IGT VPP delamination and is commonly known in the art (measured in N/m). The IGT VPP delamination of the paper substrate of the present invention may be any, but is preferably greater than 150 N/m, more preferably greater than 190 N/m, most preferably greater than 210 N/m. If the substrate is a repro-paper substrate, then the IGT VPP delamination is preferably from 150 to 175 N/m, including any and all ranges and subranges therein.

The paper substrate according to the present invention may be made off of the paper machine having either a high or low basis weight, including basis weights of at least 10 lbs/3000 square foot, preferably from at least 20 to 500 lbs/3000 square foot, more preferably from at least 40 to 325 lbs/3000 square foot. The basis weight may be at least 10, 20, 30, 40, 50, 60, 70, 80, 90, 100, 125, 150, 175, 200, 225, 250, 275, 300, 325, 350, 375, 400, 425, 450, 475, and 500 lbs/3000 square feet, including any and all ranges and subranges therein.

The paper substrate according to the present invention may have any apparent density. The apparent density may be of from 1 to 20, preferably 4 to 14, most preferably from 5 to 10 lb/3000 sq. ft.per 0.001 inch thickness. The density may be at least 1, 2, 3, 4, 5, 6, 7, 8, 9, 10, 11, 12, 13, 14, 15, 16, 17, 18, 19, and 20 lb/3000 sq. ft.per 0.001 inch thickness, including any and all ranges and subranges therein.

The paper substrate according to the present invention may have any caliper. The caliper may be from 2 to 35 mil, preferably from 5 to 30 mil, more preferably from 10 to 28 mil, most preferably from 12 to 24 mil. The caliper may be at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, and 35 mil, including any and all ranges and subranges therein.

The paper substate may optionally have an I-beam structure or perform as if an I-beam structure is contained therein. However an I-beam structure is preferred. This I-beam structure is produced as a result of the selective placement and heavily controlled locality of the sizing agent within and/or on the paper substrate. "I-Beam" and performance characteristics may be described in references such as its effect described in published application having U.S. Ser. No. 10/662,699 and having publication number 20040065423, which published on Apr. 8, 2004, which is also hereby incorporated, in its entirety, herein by reference. However, it is not known how to control the I-beam structure and/or I-Beam performance characteristics of a substrate made under paper machine and/or pilot machine conditions. An embodiment of the present invention may also include the attainment of improved I-beam structures and/or performance characteristics by tightly controlling the location of the sizing agent across the cross section of the substrate itself. Also within the current boundaries of the present invention is the opportunity to create improved I-beam structures and/or improved I-beam performance characteristics of the substrate while increasing the loading of sizing agent into and/or onto the substrate, especially controlling the external sizing agent loading therein and/or thereon.

The paper substrate of the present invention may also include optional substances including retention aids, binders, fillers, thickeners, and preservatives. Examples of fillers include, but are not limited to; clay, calcium carbonate, calcium sulfate hemihydrate, and calcium sulfate dehydrate. A preferable filler is calcium carbonate with the preferred form being precipitated calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates. Another example of optional substances are solvents including but not limited to water.

The paper substrate of the present invention may contain retention aids selected from the group consisting of coagulation agents, flocculation agents, and entrapment agents dispersed within the bulk and porosity enhancing additives cellulosic fibers. Examples of retention aids can also be found in U.S. Pat. No. 6,379,497, which is incorporated by reference in its entirety.

The paper substrate of the present invention may contain from 0.001 to 20 wt % of the optional substances based on the total weight of the substrate, preferably from 0.01 to 10 wt %, most preferably 0.1 to 5.0 wt %, of each of at least one of the optional substances. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate may be made by contacting the sizing agent with the cellulose fibers. Still fluffier, the contacting may occur at acceptable concentration levels that provide the paper substrate of the present invention to contain any of the above-mentioned amounts of cellulose and sizing agent.

The paper substrate of the present application may be made by contacting the substrate with an internal and/or surface sizing solution containing at least one sizing agent. The contacting may occur anytime in the papermaking process including, but not limited to the wet end, head box, size press, water box, and/or coater. Further addition points include machine chest, stuff box, and suction of the fan pump. The cellulose fibers, sizing agent, and/or optional components may be contacted serially, consecutively, and/or simultaneously in any combination with each other.

The paper substrate may be passed through a size press, where any sizing means commonly known in the art of papermaking is acceptable. The size press, for example, may be a puddle mode size press (e.g. inclined, vertical, horizontal) or metered size press (e.g. blade metered, rod metered). At the size press, sizing agents such as binders may be contacted with the substrate. Optionally these same sizing agents may be added at the wet end of the papermaking process as needed. After sizing, the paper substrate may or may not be dried again according to the above-mentioned exemplified means and other commonly known drying means in the art of papermaking. The paper substrate may be dried so as to contain any selected amount of water. Preferably, the substrate is dried to contain less than or equal to 10% water.

Preferably, the paper substrate is made by having at least one sizing agent contacted with the fibers at a size press. Therefore, the sizing agent is part of a sizing solution. The sizing solution preferably contains at least one sizing agent at a % solids that is at least 8 wt %, preferably at least or equal to 10 wt %, more preferably greater than or equal to 12 wt %, most preferably, greater than or equal to 13 wt % solids sizing agent. Further, the sizing solution contains from 8 to 35 wt % solids sizing agent, preferably from 10 to 25 wt % solids sizing agent, more preferably from 12 to 18 wt % solids sizing agent, most preferably from 13 to 17 wt % solids sizing agent. This range includes at least 8, 10, 12, 13, 14 wt % solids sizing agent and at most 15, 16, 17, 18, 20, 22, 25, 30, and 35 wt % solids sizing agent, including any and all ranges and subranges therein.

The sizing agent loading applied to the paper, which is about equal to, or exactly equal to the amount of external sizing and, in some instances, the total sizing, applied to the fibers may be any loading. Preferably, the sizing agent load is at least 0.25 gsm, preferably from 0.25 to 10 gsm, more preferably from 3.5 to 10 gsm, most preferably from 4.4 to 10 gsm. The sizing agent load may preferably be at least 0.25, 0.5, 1.0, 1.5, 2.0, 2.5, 3.0, 3.5, 3.6, 3.7, 3.8, 3.9, 4.0, 4.1, 4.2, 4.3, 4.4, 4.5, 4.6, 4.7, 4.8, 4.9, 5.0, 5.5, 6.0, 6.5, and may preferably be at most 7.0, 7.5, 8.0, 8.5, 9.0, 9.5, and 10.0 gsm, including any and all ranges and subranges therein.

The paper substrate may have any Internal Bond/sizing agent load ratio. In one aspect of the present invention, the substrate contains high amounts of sizing agent and/or sizing agent load, while at the same time has low Internal Bond. Accordingly, it is preferable to have the Internal Bond/sizing agent load ratio approach 0, if possible. Another manner in expressing the desired phenomenon in the substrate of the present invention, is to provide a paper substrate that has an Internal Bond that either decreases, or remains constant, or increases minimally with increasing sizing content and/or sizing loading. Another way to discuss this phenomenon is to say that the change in Internal Bond of the paper substrate is 0, negative, or a small positive number as the sizing agent load increases. It is desirable to have this paper substrate of the present invention presenting such a phenomenon at various degrees of sizing agent wt % solids that are applied to the fibers via a size press as discussed above. In an additional embodiment, it is desirable to have the paper substrate to possess any one of and/or all of the above-mentioned phenomena and also have a strong surface strength as measured by IGT pick and/or wax pick tests discussed above.

The paper substrate of the present invention may have any Internal Bond/sizing agent load ratio. The Internal Bond/sizing agent load ratio may be less than 100, preferably less than 80, more preferably less than 60, most preferably less than 40 $J/m^2$/gsm. The Internal Bond/sizing agent load ratio may be less than 100, 95, 90, 85, 80, 75, 74, 73, 72, 71, 70, 69, 68, 67, 66, 65, 64, 63, 62, 61, 60, 59, 58, 57, 56, 55, 54, 53, 52, 51, 50, 49, 48, 47, 46, 45, 44, 43, 42, 41, 40, 38, 35, 32, 30, 28, 25, 22, 20, 18, 15, 12, 10, 7, 5, 4, 3, 2, and 1 $J/m^2$/gsm, including any and all ranges and subranges therein.

In one embodiment, the paper substrate may demonstrate a phenomenon such that a change in the Internal Bond as a function of a change in the sizing agent contained by the substrate, i.e. ΔInternal Bond/Δ sizing agent wt %, and/or the change in the sizing agent load applied to the substrate, i.e. ΔInternal Bond/Δ sizing agent load, is preferably negative. That is, as the amount of sizing agent contained by the sheet is increases incrementally or as the amount of sizing agent load applied to the sheet increases incrementally, the Internal Bond decreases. Preferably, the ΔInternal Bond/Δ sizing agent wt % and/or the ΔInternal Bond/Δ sizing agent load is equal to or less than about 0, preferably less than −1, more preferably less than −5, most preferably less than −20. This range for ΔInternal Bond/Δ sizing agent wt % and/or the ΔInternal Bond/Δ sizing agent load includes less than or equal to 0, −1, −2, −3, −4, −5, −6, −7, −8, −9, −10, −11, −12, −13, −14, −15, −16, −17, −18, −19, and −20, including any and all ranges and subranges therein.

In one embodiment, the paper substrate may demonstrate a phenomenon such that a change in the Internal Bond as a function of a change in the sizing agent contained by the substrate, i.e. ΔInternal Bond/Δ sizing agent wt %, and/or the change in the sizing agent load applied to the substrate, i.e. ΔInternal Bond/Δ sizing agent load, is as small as possible in magnitude when positive. That is, as the amount of sizing agent contained by the sheet increases incrementally or as the amount of sizing agent load applied to the sheet increases incrementally, the Internal Bond increases, yet increases at a very small increment. Preferably, the ΔInternal Bond/Δ sizing agent wt % and/or the ΔInternal Bond/Δ sizing agent load is equal to or less than about 100, preferably less than 75, more preferably less than 50, most preferably less than 25. This range for ΔInternal Bond/Δ sizing agent wt % and/or the ΔInternal Bond/Δ sizing agent load includes less than or equal to 100, 95, 90, 85, 80, 75, 70, 65, 60, 55, 52, 50, 47, 45, 42, 40, 37, 35, 32, 30, 28, 25, 22, 20, 18, 15, 12, 10, 7, 5, 3, and 1, including any and all ranges and subranges therein.

In one embodiment, the ΔInternal Bond/Δ sizing agent load is less than 55, preferably less than 40, more preferably less than 30, and most preferably less than 25 when the sizing agent is applied at the size press at sizing solids of 12 wt %, 13 wt %, 14 wt %, or 16 wt %, or even greater. In an additional embodiment, the ΔInternal Bond/Δ sizing agent load is less than 55, preferably less than 40, more preferably less than 30, and most preferably less than 25 when the sizing agent is applied at the size press at sizing agent solids of 15 wt %, 16 wt %, or 17 wt % or even greater. In an additional embodiment, the ΔInternal Bond/Δ sizing agent load is less than 55, preferably less than 40, more preferably less than 30, and most preferably less than 25 when the sizing agent is applied at the size press at sizing agent solids of 18 wt %, 19 wt %, or 20 wt % or even greater. Each of these ranges above include, but are not limited to less than 55, 54, 53, 52, 51, 50, 48, 46, 44, 42, 40, 38, 35, 32, 30, 28, 25, 23, 20, 18, 15, 12, 10, 7, 5, 2, 0, −1, −5, −10, and −20 when the sizing agent is applied at the size press at solids of 12 wt %, 13 wt %, 14 wt %, 15 wt %, 16 wt %, 17 wt %, 18 wt %, 19 wt %, 20 wt %, or even greater, including any and all ranges and subranges therein.

When the fibers are contacted with the sizing agent at the size press, it is preferred that the viscosity of the sizing solution is from 100 to 500 centipoise using a Brookfield Viscometer, number 2 spindle, at 100 rpm and 150° F. Preferably, the viscosity is from 125 to 450, more preferably from 150 to 300 centipoise as measured by the standard indicated above. This range includes 100, 125, 150, 160, 170, 180, 190, 200, 210, 220, 230, 240, 250, 260, 270, 280, 290, 300, 325, 350, 375, 400, 425, and 450 centipoise as measured using a Brookfield Viscometer, number 2 spindle, at 100 rpm and 150° F., including any and all ranges and subranges therein.

When the sizing solution containing the sizing agent is contacted with the fibers at the size press to make the paper substrate of the present invention, the effective nip pressure may be any nip pressure, but preferable is from 80 to 300, more preferably from 90 to 275, most preferably from 100 to 250 lbs per linear inch. The nip pressure may be at least 80, 90, 100, 110, 120, 130, 140, 150, 160, 170, 180, 190, 200, 210, 220, 230, 240, 250, 260, 270, 280, 290, and 300 lbs per linear inch, including any and all ranges and subranges therein.

In addition, the rolls of the size press may have a P&J hardness, preferably any P&J hardness. Since there are two rolls, a first roll may have a first hardness, while a second roll may have a second hardness. The first hardness and the second hardness may be equal and/or different from one another. As an example, the P&J of a first roll at the size press may have a first hardness that is 35 P&J hardness, while the second roll have a second hardness that is 35 P&J hardness. Alternatively and only to exemplify, the P&J of a first roll at the size press may have a first hardness that is 35 P&J hardness, while the second roll have a second hardness that is 45 P&J hardness. Even though the rolls may have any P&J, it is preferred that the rolls be softer rather than harder at the size press.

The paper substrate may be pressed in a press section containing one or more nips. However, any pressing means commonly known in the art of papermaking may be utilized. The nips may be, but is not limited to, single felted, double felted, roll, and extended nip in the presses. However, any nip commonly known in the art of papermaking may be utilized.

The paper substrate may be dried in a drying section. Any drying means commonly known in the art of papermaking may be utilized. The drying section may include and contain a drying can, cylinder drying, Condebelt drying, IR, or other drying means and mechanisms known in the art. The paper substrate may be dried so as to contain any selected amount of water. Preferably, the substrate is dried to contain less than or equal to 10% water.

The paper substrate may be calendered by any commonly known calendaring means in the art of papermaking. More specifically, one could utilize, for example, wet stack calendering, dry stack calendering, steel nip calendaring, hot soft calendaring or extended nip calendering, etc.

The paper substrate may be microfinished according to any microfinishing means commonly known in the art of papermaking. Microfinishing is a means involving frictional processes to finish surfaces of the paper substrate. The paper substrate may be microfinished with or without a calendering means applied thereto consecutively and/or simultaneously. Examples of microfinishing means can be found in United States Published Patent Application 20040123966 and references cited therein, as well as U.S. Provisional Patent Application having U.S. Ser. No. 60/810,181 filed Jun. 2, 2006 and entitled "PROCESS FOR SMOOTHING THE SURFACE OF FIBROUS WEBS", which are all hereby, in their entirety, herein incorporated by reference.

The paper board and/or substrate of the present invention may also contain at least one coating layer, including two coating layers and a plurality thereof. The coating layer may be applied to at least one surface of the paper board and/or substrate, including two surfaces. Further, the coating layer may penetrate the paper board and/or substrate. The coating layer may contain a binder. Further the coating layer may also optionally contain a pigment. Other optional ingredients of the coating layer are surfactants, dispersion aids, and other conventional additives for printing compositions.

The substrate and coating layer are contacted with each other by any conventional coating layer application means, including impregnation means. A preferred method of applying the coating layer is with an in-line coating process with one or more stations. The coating stations may be any of known coating means commonly known in the art of papermaking including, for example, brush, rod, air knife, spray, curtain, blade, transfer roll, reverse roll, and/or cast coating means, as well as any combination of the same.

The coated substrate may be dried in a drying section. Any drying means commonly known in the art of papermaking and/or coatings may be utilized. The drying section may include and contain IR, air impingement dryers and/or steam heated drying cans, or other drying means and mechanisms known in the coating art.

The coated substrate may be finished according to any finishing means commonly known in the art of papermaking. Examples of such finishing means, including one or more finishing stations, include gloss calendar, soft nip calendar, and/or extended nip calendar.

These above-mentioned methods of making the composition, particle, and/or paper substrate of the present invention may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as coated and/or uncoated paper products, board, and/or substrates. Textbooks such as those described in the "Handbook for pulp and paper technologists" by G. A. Smook (1992), Angus Wilde Publications, which is hereby incorporated, in its entirety, by reference. For example, the fiber may be prepared for use in a papermaking furnish by any known suitable digestion, refining, and bleaching operations as for example known mechanical, thermo mechanical, chemical and semi chemical, etc., pulping and other well known pulping processes. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention.

The substrate may also include other conventional additives such as, for example, starch, mineral and polymeric fillers, retention aids, and strengthening polymers. Among the fillers that may be used are organic and inorganic pigments such as, by way of example, minerals such as calcium carbonate, kaolin, and talc and expanded and expandable microspheres. Other conventional additives include, but are not restricted to, wet strength resins, internal sizes, dry strength resins, alum, fillers, pigments and dyes. The substrate may include bulking agents such as expandable microspheres, pulp fibers, and/or diamide salts.

Examples of expandable microspheres having bulking capacity are those described in U.S. Patent Application No. 60/660,703 filed Mar. 11, 2005, entitled "COMPOSITIONS CONTAINING EXPANDABLE MICROSPHERES AND AN IONIC COMPOUND, AS WELL AS METHODS OF MAKING AND USING THE SAME", and U.S. patent application Ser. No. 11/374,239 filed Mar. 13, 2006, which are also hereby incorporated, in their entirety, herein by reference. Further examples include those found in U.S. Pat. No. 6,379,497 filed May 19, 1999 and United States Patent Application having Publication Number 20060102307 filed Jun. 1, 2004, which are also hereby incorporated, in their entirety, herein by reference. When such bulking agents are added, from 0.25 to 20, preferably from 3 to 15 lb of bulking agent are added (e.g. expandable microspheres and/or the composition and/or particle discussed below) per ton of cellulose fibers.

Examples of bulking fibers include, for example, mechanical fibers such as ground wood pulp, BCTMP, and other mechanical and/or semi-mechanical pulps. A more specific representative example is provided below. When such pulps are added, from 0.25 to 75 wt %, preferably less than 60 wt % of total weight of the fibers used may be from such bulking fibers.

Examples of diamide salts include those described in United States Patent Application having Publication Number 20040065423 filed Sep. 15, 2003, which is also hereby incorporated, in their entirety, herein by reference. Such salts include mono- and distearamides of animoethylethalonalamine, which may be commercially known as Reactopaque 100, (Omnova Solutions Inc., Performance Chemicals, 1476 J. A. Cochran By-Pass, Chester, S.C. 29706, USA and marketed and sold by Ondeo Nalco Co., with headquarters at Ondeo Nalco Center, Naperville, Ill. 60563, USA) or chemical equivalents thereof. When such salts are used, about 0.025 to about 0.25 wt % by weight dry basis of the diamide salt may be used.

In one embodiment of the present invention, the substrate may include bulking agents such as those described in U.S. Patent Application No. 60/660,703 filed Mar. 11, 2005, entitled "COMPOSITIONS CONTAINING EXPANDABLE MICROSPHERES AND AN IONIC COMPOUND, AS WELL AS METHODS OF MAKING AND USING THE SAME", which is also hereby incorporated, in its entirety, herein by reference. This embodiment is explained in detail below.

The paper substrate of the present invention may contain from 0.001 to 10 wt %, preferably from 0.02 to 5 wt %, more preferably from 0.025 to 2 wt %, most preferably from 0.125 to 0.5 wt % of the composition and/or particle of the present invention based on the total weight of the substrate. The range includes 0.001, 0.005, 0.01, 0.05, 1.0, 1.5, 2.0, 2.5, 3.0, 3.5, 4.0, 4.5, and 5.0 wt %, including any and all ranges and subranges therein.

The paper substrate according to the present invention may contain a bulking means/agent ranging from 0.25 to 50, preferably from 5 to 20, dry lb per ton of finished product when such bulking means is an additive. This range includes 0.25, 0.5, 0.75, 1.0, 2.0, 2.5, 3.0, 3.5, 4, 4.5, 5, 5.5, 6, 6.5, 7, 7.5, 8, 8.5, 9, 9.5, 10, 11, 12, 13, 14, 15, 20, 25, 30, 35, 40, 45, and 50 dry lb per ton of finished product, including any and all ranges and subranges therein.

When the paper substrate contains a bulking agent, the bulking agent is preferably an expandable microsphere, composition, and/or particle for bulking paper articles and substrates. However, in this specific embodiment, any bulking means can be utilized, while the expandable microsphere, composition, particle and/or paper substrate of that follows is the preferred bulking means. Examples of other alternative bulking means may be, but is not limited to, surfactants, Reactopaque, pre-expanded spheres, BCTMP (bleached chemi-thermomechanical pulp), microfinishing, and multiply construction for creating an I-Beam effect in a paper or paper board substrate. Such bulking means may, when incorporated or applied to a paper substrate, provide adequate print quality, caliper, basis weight, etc in the absence harsh calendaring conditions (i.e. pressure at a single nip and/or less nips per calendaring means), yet produce a paper substrate having the a single, a portion of, or combination of the physical specifications and performance characteristics mentioned herein.

When the paper substrate of the present invention contains a bulking agent, the preferred bulking agent is as follows.

The paper substrate of the present invention may contain from 0.001 to 10 wt %, preferably from 0.02 to 5 wt %, more preferably from 0.025 to 2 wt %, most preferably from 0.125 to 0.5 wt % of expandable microspheres based on the total weight of the substrate.

The expandable microspheres may contain an expandable shell forming a void inside thereof. The expandable shell may comprise a carbon and/or heteroatom containing compound. An example of a carbon and/or heteroatom containing compound may be an organic polymer and/or copolymer. The polymer and/or copolymer may be branched and/or crosslinked.

Expandable microspheres preferably are heat expandable thermoplastic polymeric hollow spheres containing a thermally activatable expanding agent. Examples of expandable microsphere compositions, their contents, methods of manufacture, and uses can be found, in U.S. Pat. Nos. 3,615,972; 3,864,181; 4,006,273; 4,044,176; and 6,617,364 which are hereby incorporated, in their entirety, herein by reference. Further reference can be made to published U.S. Patent Applications: 20010044477; 20030008931; 20030008932; and 20040157057, which are hereby incorporated, in their entirety, herein by reference. Microspheres may be prepared from polyvinylidene chloride, polyacrylonitrile, poly-alkyl methacrylates, polystyrene or vinyl chloride.

Microspheres may contain a polymer and/or copolymer that has a Tg ranging from −150 to +180° C., preferably from 50 to 150° C., most preferably from 75 to 125° C.

Microspheres may also contain at least one blowing agent which, upon application of an amount of heat energy, functions to provide internal pressure on the inside wall of the microsphere in a manner that such pressure causes the sphere to expand. Blowing agents may be liquids and/or gases. Further, examples of blowing agents may be selected from low boiling point molecules and compositions thereof. Such blowing agents may be selected from the lower alkanes such as neopentane, neohexane, hexane, propane, butane, pentane, and mixtures and isomers thereof. Isobutane is the preferred blowing agent for polyvinylidene chloride microspheres. Suitable coated unexpanded and expanded microspheres are disclosed in U.S. Pat. Nos. 4,722,943 and 4,829,094, which are hereby incorporated, in their entirety, herein by reference.

The expandable microspheres may have a mean diameter ranging from about 0.5 to 200 microns, preferably from 2 to 100 microns, most preferably from 5 to 40 microns in the unexpanded state and having a maximum expansion of from about 1.5 and 10 times, preferably from 2 to 10 times, most preferably from 2 to 5 times the mean diameters.

The expandable microspheres may be negatively or positively charged. Further, the expandable microspheres may be neutral. Still further, the expandable microspheres may be incorporated into a composition and/or particle of the present invention that has a net zeta potential that is greater than or equal to zero mV at a pH of about 9.0 or less at an ionic strength of from $10^{-6}$ M to 0.1M.

In the composition and/or particle of the present invention, the expandable microspheres may be neutral, negatively or positively charged, preferably negatively charged.

Further, the composition and/or particle of the present invention may contain expandable microspheres of the same physical characteristics disclosed above and below and may be incorporated into the paper substrate according to the present invention in the same manner and the same amounts as mentioned above and below for the expandable microspheres.

Still further, the composition and/or particle of the present invention may contain expandable microspheres and at least one ionic compound. When the composition and/or particle of the present invention contains expandable microspheres and at least one ionic compound, the composition and/or particle of the present invention that has a net zeta potential that is greater than or equal to zero mV at a pH of about 9.0 or less at an ionic strength of from $10^{-6}$ M to 0.1M. Preferably, the net zeta potential is from greater than or equal to zero to +500, preferably greater than or equal to zero to +200, more preferably from greater than or equal to zero to +150, most preferably from +20 to +130, mV at a pH of about 9.0 or less at an ionic strength of from $10^{-6}$M to 0.1M as measured by standard and conventional methods of measuring zeta potential known in the analytical and physical arts, preferably methods utilizing microelectrophoresis at room temperature.

The ionic compound may be anionic and/or cationic, preferably cationic when the expandable microspheres are anionic. Further, the ionic compound may be organic, inorganic, and/or mixtures of both. Still further, the ionic compound may be in the form of a slurry and/or colloid. Finally, the ionic compound may have a particle size ranging 1 nm to 1 micron, preferably from 2 nm to 400 nm.

The ionic compound may be any of the optional substances and conventional additives mentioned below and/or commonly known in the art of papermaking. More preferably, the ionic compound may be any one or combination of the retention aids mentioned below.

The weight ratio of ionic compound to expandable microsphere in the composition and/or particle of the present invention may be from 1:500 to 500:1, preferably from 1:50 to 50:1, more preferably from 1:10 to 10:1, so long as the composition and/or particle has a net zeta potential that is greater than or equal to zero mV at a pH of about 9.0 or less at an ionic strength of from $10^{-6}$ M to 0.1M.

The ionic compound may be inorganic. Examples of the inorganic ionic compound may contain, but are not limited to silica, alumina, tin oxide, zirconia, antimony oxide, iron oxide, and rare earth metal oxides. The inorganic may preferably be in the form of a slurry and/or colloid and/or sol when contacted with the expandable microsphere and have a particle size ranging from 1 nm to 1 micron, preferably from 2 nm, to 400 micron. When the inorganic ionic compound is in the form of a colloid and/or sol, the preferred compound contains silica and/or alumina.

The ionic compound may be organic. Examples of the ionic organic compound may be carbon-containing compounds. Further, the ionic organic compound may contain heteroatoms such as nitrogen, oxygen, and/or halogen. Still further, the ionic organic compound may contain a heteroatom-containing functional group such as hydroxy, amine, amide, carbony, carboxy, etc groups. Further the ionic organic compound may contain more that one positive charge, negative charge, or mixtures thereof. The ionic organic compound may be polymeric and/or copolymeric, which may further by cyclic, branched and/or crosslinked. When the ionic organic compound is polymeric and/or copolymeric, the compound preferably has a weight average molecular weight of from 600 to 5,000,000, more preferably from 1000 to 2,000,000, most preferably from 20,000 to 800,000 weight average molecular weight. Preferably, the ionic organic compound may be an amine containing compound. More preferably, the ionic organic compound may be a polyamine. Most preferably, the ionic organic compound may be a poly(DADMAC), poly(vinylamine), and/or a poly(ethylene imine).

The composition and/or particle of the present invention may contain at least one expandable microsphere and at least one ionic compound where the ionic compound is in contact with the outer surface of the expandable microsphere. Such contact may include a system where the expandable microsphere is coated and/or impregnated with the ionic compound. Preferably, while not wishing to be bound by theory, the ionic compound is bonded to the outside surface of the expandable microsphere by non-covalent inter molecular forces to form a particle having an inner expandable microsphere and outer ionic compound layered thereon. However, portions of the outer surface of the expandable microsphere layer may not be completely covered by the outer ionic compound layer, while portions of the outer surface of the expandable microsphere layer may actually be completely covered by the outer ionic compound layer. This may lead to some portions of the outer surface of the expandable microsphere layer being exposed.

The composition and/or particle of the present invention may be made by contacting, mixing, absorbing, adsorbing, etc, the expandable microsphere with the ionic compound. The relative amounts of expandable microsphere and ionic compound may be tailored by traditional means just as long as the as the resultant composition and/or particle has a net zeta potential that is greater than or equal to zero mV at a pH of about 9.0 or less at an ionic strength of from $10^{-6}$ M to 0.1M. Preferably, the weight ratio of ionic compound contacted with the expandable microsphere in the composition and/or particle of the present invention may be from 1:100 to 100:1, preferably from 1:80 to 80:1, more preferably from 1:1 to 1:60, most preferably from 1:2 to 1:50 so long as the composition and/or particle has a net zeta potential that is greater than or equal to zero mV at a pH of about 9.0 or less at an ionic strength of from $10^{-6}$ M to 0.1M.

The amount of contact time between the ionic compound and the expandable microsphere can vary from milliseconds to years just as long as the resultant composition and/or particle has a net zeta potential that is greater than or equal to zero mV at a pH of about 9.0 or less at an ionic strength of from $10^{-6}$ M to 0.1M. Preferably, the contacting occurs from 0.01 second to 1 year, preferably from 0.1 second to 6 months, more preferably from 0.2 seconds to 3 weeks, most preferably from 0.5 seconds to 1 week.

Prior to contacting the expandable microsphere with the ionic compound, each of the expandable microsphere and/or the ionic compound may be a slurry, wet cake, solid, liquid, dispersion, colloid, gel, respectively. Further, each of the expandable microsphere and/or the ionic compound may be diluted.

The composition and/or particle of the present invention may have a mean diameter ranging from about 0.5 to 200 microns, preferably from 2 to 100 microns, most preferably from 5 to 40 microns in the unexpanded state and having a maximum expansion of from about 1.5 and 10 times, preferably from 2 to 10 times, most preferably from 2 to 5 times the mean diameters.

The composition and/or particle of the present invention may be made through the above-mentioned contacting means prior to and/or during the papermaking process. Preferably, the expandable microsphere and the ionic compound are contacted so as to produce the composition and/or particle of the present invention and then such resultant composition and/or particle of the present invention is subsequently and/or simultaneously contacted with the fibers mentioned below.

The paper substrate may be made by contacting the bulking agent (e.g. expandable microspheres and/or the composition and/or particle discussed above) with the cellulose fibers consecutively and/or simultaneously. Still further, the contacting may occur at acceptable concentration levels that provide the paper substrate of the present invention to contain any of the above-mentioned amounts of cellulose and bulking agent (e.g. expandable microspheres and/or the composition and/or particle discussed above) isolated or in any combination thereof. More specifically, the paper substrate of the present application may be made by adding from 0.25 to 20, preferably from 5 to 15, most preferably from 7 to 12, lb of bulking agent (e.g. expandable microspheres and/or the composition and/or particle discussed above) per ton of cellulose fibers. This range includes 0.25, 0.5, 0.75, 1.0, 2.0, 2.5, 3.0, 3.5, 4, 4.5, 5, 5.5, 6, 6.5, 7, 7.5, 8, 8.5, 9, 9.5, 10, 11, 12, 13, 14, 15, 20, 25, 30, 35, 40, 45, and 50 dry lb per ton of finished product, including any and all ranges and subranges therein.

The contacting may occur anytime in the papermaking process including, but not limited to the thick stock, thin stock, head box, and coater with the preferred addition point being at the thin stock. Further addition points include machine chest, stuff box, and suction of the fan pump.

The paper substrate may be made by contacting further optional substances with the cellulose fibers as well. The contacting may occur anytime in the papermaking process including, but not limited to the thick stock, thin stock, head box, size press, water box, and coater. Further addition points include machine chest, stuff box, and suction of the fan pump. The cellulose fibers, bulking agent, sizing agent, and/or optional components may be contacted serially, consecutively, and/or simultaneously in any combination with each other. The cellulose fibers and bulking agent may be premixed in any combination before addition to or during the paper-making process.

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiments The present invention is explained in more detail with the aid of the following embodiment example which is not intended to limit the scope of the present invention in any manner.

EXAMPLES

Example 1

The following is a description of one methodology to use when quantifying Q as described in the above pages.

A novel method for determining a quantified starch penetration number, Q, using image analysis (Lappalainen, Solasaari, Lipponen, 2005) was investigated and described in this report. When starch penetration in the z direction decreases, the dimensionless number, Qtotal, approaches zero. If starch is distributed completely in the z-direction, the value of Qtotal is 0.5. Three paper samples were investigated in this study. The Qtotal values for carton, C1S board, and copy paper were 0.2, 0.5, and 0.5, respectively, in qualitative agreement with visual perception. Note that image analysis data do not yield actual weight percentages of starch or penetration depths and care must be taken not to misrepresent the data. This method will provide a new tool for optimizing and fine tuning starch-penetration-related process parameters.

Starch penetration and its distribution in the z-direction in paper and paperboards are of great interest for relating process variables to properties of paper. During the TAPPI coating conference in April 2005, a dimensionless penetration number, Q, was introduced to aid in the evaluation of image analysis data for starch penetration (Lappalainen, Lipponen, Solasaari, 2005). This approach could facilitate a semiquantitative comparison, or ranking, of paper samples with different starch penetration levels. The objective of this report was to replicate the authors' technique to determine Qtotal in different starch-sized papers, using a standard compound microscope and freely available software.

Results and Discussion of Example 1

Figure 4A:
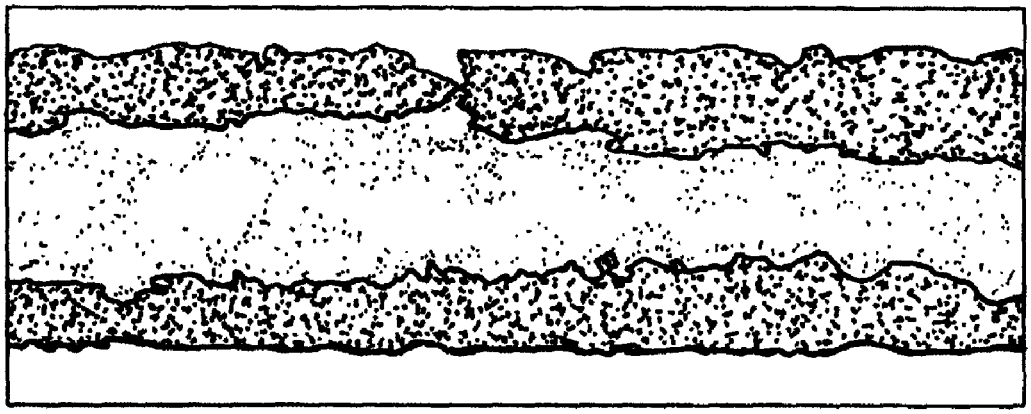
FIG. 4A is a micrograph of a representative cross section of a paper substrate sample examined using the process of Example 1.
Figure 4B:
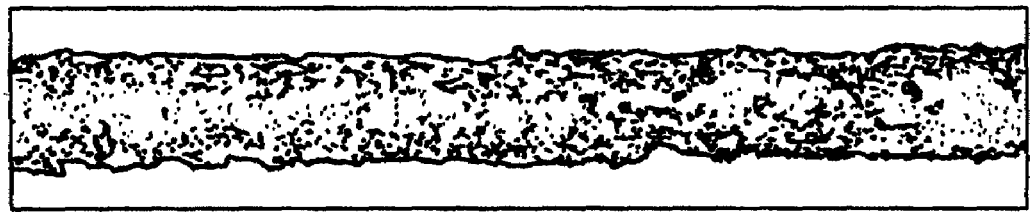
FIG. 4B is another micrograph of a representative cross section of a paper substrate sample examined using the process of Example 1.
Figure 4C:
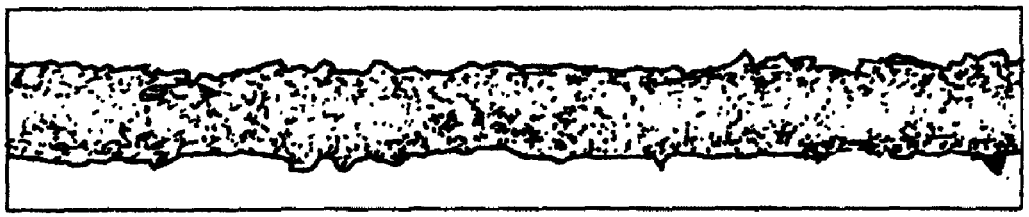
FIG. 4C is another micrograph of a representative cross section of a paper substrate sample examined using the process of Example 1.

Three paper and board samples with different levels of starch were selected for the evaluation. Five replicates from each sample were cross-sectioned and stained with an I2/KI solution (approximately 2N). The cross-sections were photographed using a light microscope at 10×. Micrographs of representative cross-sections are shown in FIGS. 4A, 4B, and 4C. Image analysis freeware, ImageJ, was used in this study (downloaded from http://rsb.info.nih.gov/ij/). Images were converted to 8-bit grayscale with enhanced contrast (normalized over the full range). The saturated pixel value was set to default, 0.5%, and the auto-threshold option was selected. The cross-section was divided into four rectangular slices of equal thickness (four equal regions of interest, "ROI") and these slices were defined as top, top-middle, middle-bottom, and bottom. Based on the auto-threshold, the fraction of iodine-stained area within each ROI was calculated. The penetration numbers Qtop and Qbottom were calculated using equations shown below. The mean penetration number Qtotal was then calculated as the weighted average of the penetration numbers obtained from the two sides.

$$Q_{top} = \frac{\text{Area } Fraction_{top-middle}}{\text{Area } Fraction_{top} + \text{Area } Fraction_{top-middle}}$$

$$Q_{bottom} = \frac{\text{Area } Fraction_{middle-bottom}}{\text{Area } Fraction_{bottom} + \text{Area } Fraction_{middle-bottom}}$$

$$Q_{total} = \frac{\text{Area } Fraction_{top-middle} + \text{Area } Fraction_{middle-bottom}}{\text{Area } Fraction_{top} + \text{Area } Fraction_{top-middle} + \text{Area } Fraction_{middle-bottom} + \text{Area } Fraction_{bottom}}$$

The above equation suggests that when starch penetration decreases, Q approaches zero. If the starch is distributed evenly in the z-direction, the value of Q is 0.5. If Q>0.5, there is more starch in the inner parts of the cross-section sample than on its surfaces. The results for three paper samples are presented in Table 1. The results matched well with our visual perceptions of micrographs of the samples. Referring to the images, for the carton sample, the starch remained on the surfaces and did not penetrate in the z direction. The other samples showed higher concentration of starch on the surface but also displayed complete penetration.

TABLE 1

The dimensionless penetration number Q for different samples.

| Sample | Q |
|---|---|
| Juice Carton | 0.2 (±0.08) |
| C1S Board | 0.5 (±0.01) |
| Copy Paper | 0.5 (±0.01) |

The starch penetration number, Q, obtained with the method described here cannot be directly interpreted as starch content distribution: we are literally comparing thresholded gray-level percentages and these may not be directly related to weight percentages of starch. For example, assume that our chosen gray threshold is equivalent to 5% starch by weight. Any starch percentage above 5% will exceed the threshold and there will be no distinction between 5% and higher. From the preceding example, it can be readily inferred that image analysis methods are sensitive to differences in thresholding. Though not performed with statistical rigor, repeated testing by different analysts on these samples using manual thresholding indicated that the calculated area percentage was not sensitive to minor variations in the threshold. Perhaps more importantly, the auto-threshold function was not found to introduce significant additional variation. It is worth noting that these specimens were imaged in reflected light and the contrast between white paper and the starch-iodine complex was readily apparent. In transmitted light, as with thin epoxy-embedded cross sections, it becomes far more difficult to separate bubbles and regions of filler (blocked light) from purple iodine-starch complex: they will threshold at similar gray levels. The authors used a grayscale reference target during image collection to ensure repeatable reflected-light illumination. They also made use of back lighting to help improve contrast and camera response. These refinements in technique will be considered in future work.

Summary of Example 1

A semi-quantitative method to evaluate starch penetration by calculating a dimensionless penetration number, Qtotal, was replicated in this study. This number can be used in comparing penetration of starch in different paper samples to determine the effect of papermaking process variation.

Example 2

The following is a description of another methodology to use when quantifying Q as described in the above pages.

Procedure of Example 2

Paper was cut to 1 cm width then clamped between machined stainless steel blocks. The cross sections were prepared by single-edged razor, rapidly dragged flush along the face of the polished stainless-steel clamp, cutting the protruding paper. While still clamped, the paper specimen was stained with iodine/potassium iodide solution (approximately 0.1 N). For that procedure a droplet of the iodine solution was dragged across the x-section and then wiped away. The moistened specimen was allowed to react and absorb at least three minutes before capturing images. The paper was advanced out of the clamp approximately 1 mm (a double thickness of blotter served as a gage) and retightened.

Images were obtained from random locations along the cross section by a digital microscope camera (Olympus DP-10, SHQ jpeg mode, 1280×1024 pixels) mounted on an Olympus BX-40 compound microscope equipped for epi-illumination and polarized light analysis. Both polarizer slides were in place during image acquisition. Random image capture was ensured by advancing the cross section without observing the camera screen or looking through the microscope.

The microscope was equipped with 12 v halogen illuminator. The illuminator was set to approximately 11 v. An external microscope light meter (Olympus EMM 7) was used on the right ocular to monitor the reflected light. A gray paint-on-paper chip (Sherwin Williams Serious Gray, SW 6256) was used as a reflectance standard. The light was metered to the 7/10 full-scale setting on the high (middle) meter band. Reductions in the light level were performed using the aperture diaphragm within the incident light path of the microscope. The equivalent exposure at 7/10 full scale was aperture f/3.5 at 1/125 sec (determined using a Nikon CoolPix 950 digital camera set to ISO 100 sensitivity, installed on the right ocular) giving an exposure value of approximately 10.5 (ev10.5 is 4.5 stops slower than the photographic standard "sunny f/16" or ev15).

Strips of the SW Serious Gray paint chip were cut to fit the faces of the stainless-steel clamp adjacent to the stained paper x-section. These strips provided a uniform background of a de-focused middle gray value while exposing the focused cross-section. The camera was set to matrix-meter mode and auto exposure. The 20× objective was used, resulting in an image field length of 0.55 mm. Thirty images netted a total analysis length of 16.5 mm, in excess of a recommended minimum reported in the literature.

For a typical 1 cm wide strip of paper, 6-to-8 images were collected. For each paper sample the images were typically collected from four or five different cross sections. The jpeg images (the only mode available on the DP-10 camera) were resaved in tiff format before processing using Adobe Photoshop 5.5 with FoveaPro4 image analysis plug-ins (Reindeer Graphics, John Russ).

The image analysis process using FoveaPro 4 software consisted of several steps. The first procedures included background fitting and subtraction; rotating the cross section to achieve a horizontal top surface and setting a rectangular region of interest to include as much of the cross section as possible while including a minimum of background. The fitting of the perfect rectangular region of interest to an uneven paper perimeter resulted in an intermediate brightness between the dark-stained specimen perimeter and the much brighter gray background. Typical background regions carried a pixel brightness of 160 (on a 256, 8 bit gray scale) while dark-stained regions were below 40, hence the edge regions of the cross sections were typically near a brightness level of 100 and declined to full darkness. The green color plane was selected and converted to gray scale (automatic in PhotoShop), the average pixel darkness across the image in a rastor scan was calculated (an embedded command in Photshop/FoveaPro: Filter/IP*Measure Global/Profiles/Vertical (averaged horizontally) resulting in a distribution of mean pixel brightness from top to bottom face of the paper cross-section. These x-section brightness distributions were collected for each of the thirty images into an MS Excel spreadsheet and then averaged.

Since there was a significant range in caliper between the 30 images, the spread in the intensity data increased significantly from left to right (top-to-bottom face of the cross section). Physically, the starch is applied to the surface or surfaces of the sheet and penetrates: the right side starting point (top surface) is no less certain than the left side (bottom surface). Therefore the data were plotted a second time, this time shifting the data set so that the right ends lined up at the same starting point. This was achieved in the Excel spreadsheet by copying empty cells into the beginning of each data column, shifting the column of data so that it terminated at the same row as the maximum caliper specimen in the 30-specimen dataset. As an example, consider a dataset ranging in caliper from 0.1 to 0.15 mm. Empty cells would be inserted at the beginning of the data range for the short caliper samples (caliper less than 0.15) so that they all lined up at the same final row of the spreadsheet as the 0.15 mm sample. A mean graph was calculated from each of the resulting datasets.

From the original dataset a mean caliper was calculated. This was a straight average of all of the traces.

For our previous example, assume that the mean caliper was 0.12 mm. In order to combine the two mean graphs (the original and right-shifted plots), 0.3 mm was truncated from the less certain end of each. This resulted in two plots that agreed in caliper with the mean caliper, and enabled a best estimate of the penetration depth to local dark minima from either surface.

A composite graph was generated by combining the best left (top penetration) and right ends (right-shifted, bottom penetration) and using an average of the two plots in the center. The length of this central region was determined by dividing the distance between the dark minima into thirds and averaging the central third region.

A line was drawn between the two minima. An area of interest for calculations was bounded at the top by the composite curve and at the bottom by the drawn straight line. The slope of each leg of the curve within the interest region was calculated using Excel's trend line function applied between the local minima and a point along the upper curve defined as the weighted average brightness along the curve between the two minima.

An additional data point was calculated as the area bounded between the straight line and the upper curve. This area was calculated in Excel as the summation of the areas, defined as the height difference between the curve and straight line multiplied by the calibrated distance between adjacent measurement points, exactly analogous to a Reimann sum.

A "Q" number was calculated as the ratio of the sum of the two areas near the tails to the total area of the region of interest (tail regions plus central region).

Figure 5A:
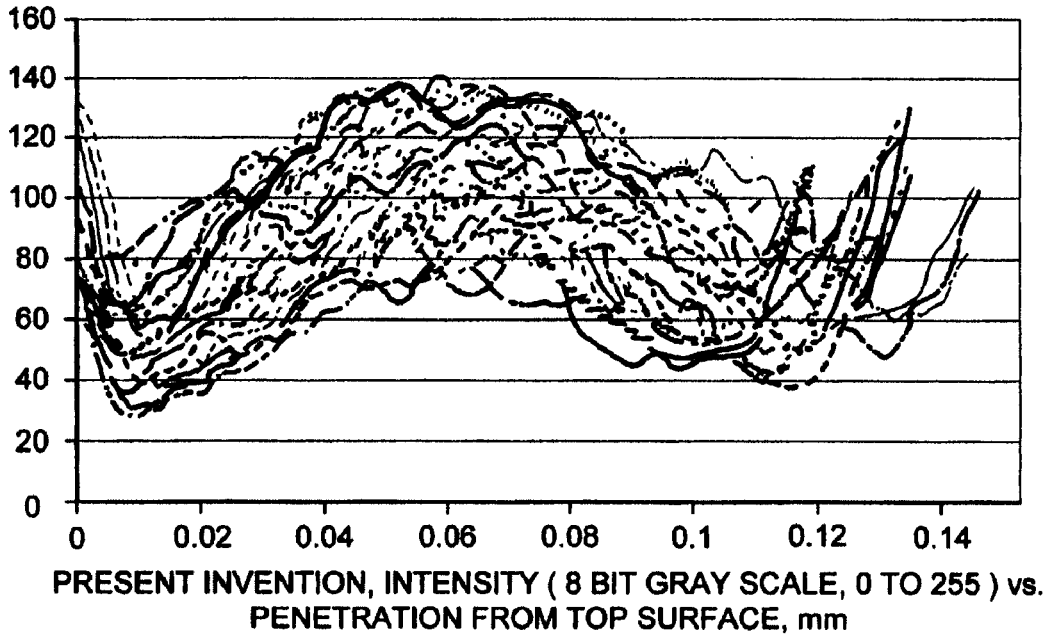
FIG. 5A is a graphical representation of thirty traces measured according to the procedure described in Example 2 on a paper substrate of the present invention with the left ends of each aligned.
Figure 5B:
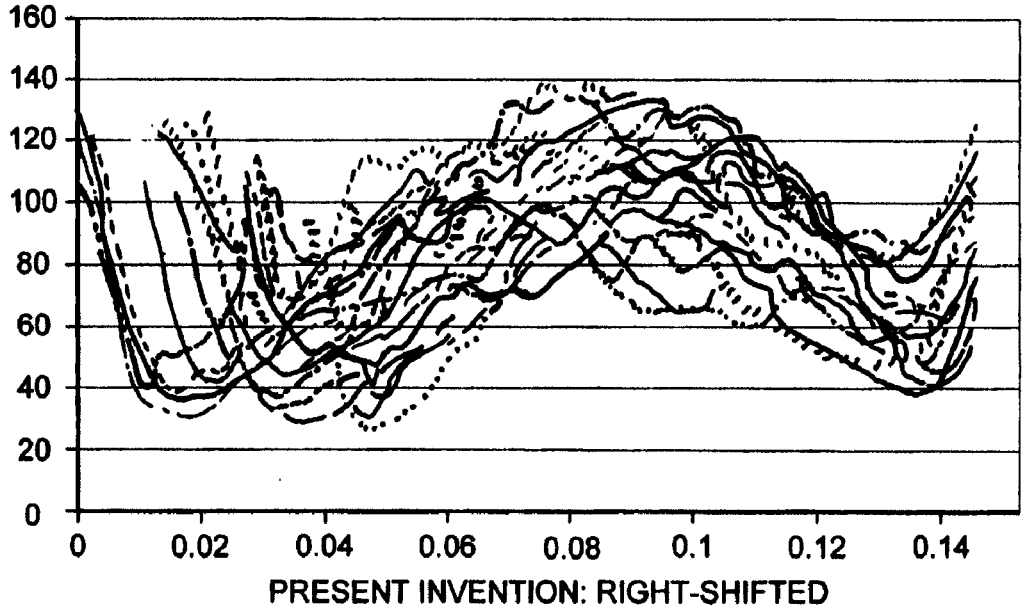
FIG. 5B is another graphical representation of thirty traces measured according to the procedure described in Example 2 on a paper substrate of the present invention with the right ends of each aligned.

The dataset, thirty individual traces, is shown graphed with left end of traces aligned (FIG. 5A) and again with right end of traces aligned (FIG. 5B). The increased variation at the non-aligned trace ends is readily apparent. From the total dataset, an estimate of the caliper was calculated. From the top graph it may be seen that the caliper ranged from about 0.11 to 0.14 mm. The mean caliper for this dataset was calculated as 0.118 mm.

Figure 6A:
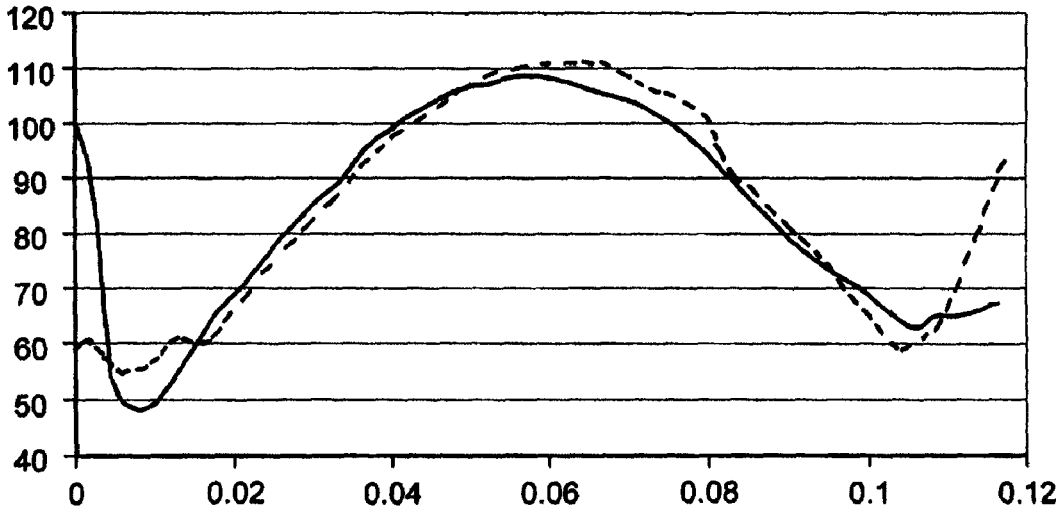
FIG. 6A is a graphical representation of the mean plots according to the procedure described in Example 2 on a paper substrate of the present invention.
Figure 6B:
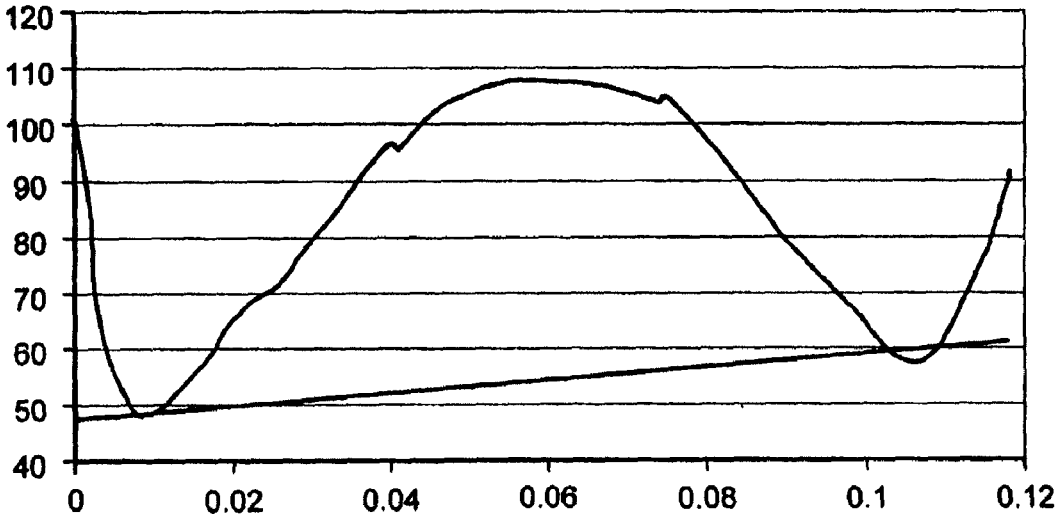
FIG. 6B is a graphical representation of the composite curve according to the procedure described in Example 2 on a paper substrate of the present invention.

FIG. 6A shows the mean plots of the shifted curves were truncated to the mean caliper at the poor end of each curve. A composite curve in FIG. 6B was formed such that the most reliable data were retained at each end. The middle portion of the graph was an average of the two mean plots. The length of this middle portion was defined as the central third between the two minima.

Figure 6C:
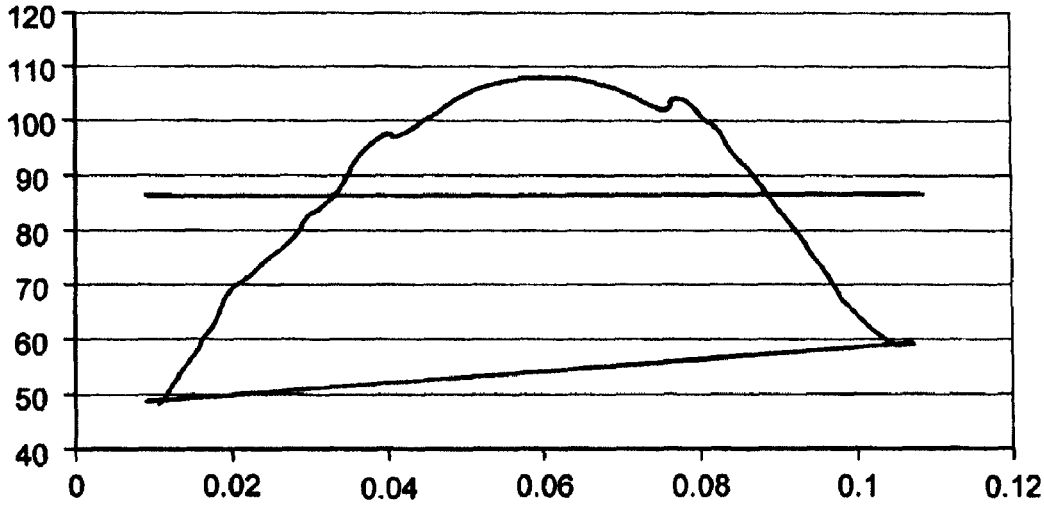
FIG. 6C is a graphical representation of the composite curve including a line drawn between the two minima therein according to the procedure described in Example 2 on a paper substrate of the present invention.
Figure 7A:
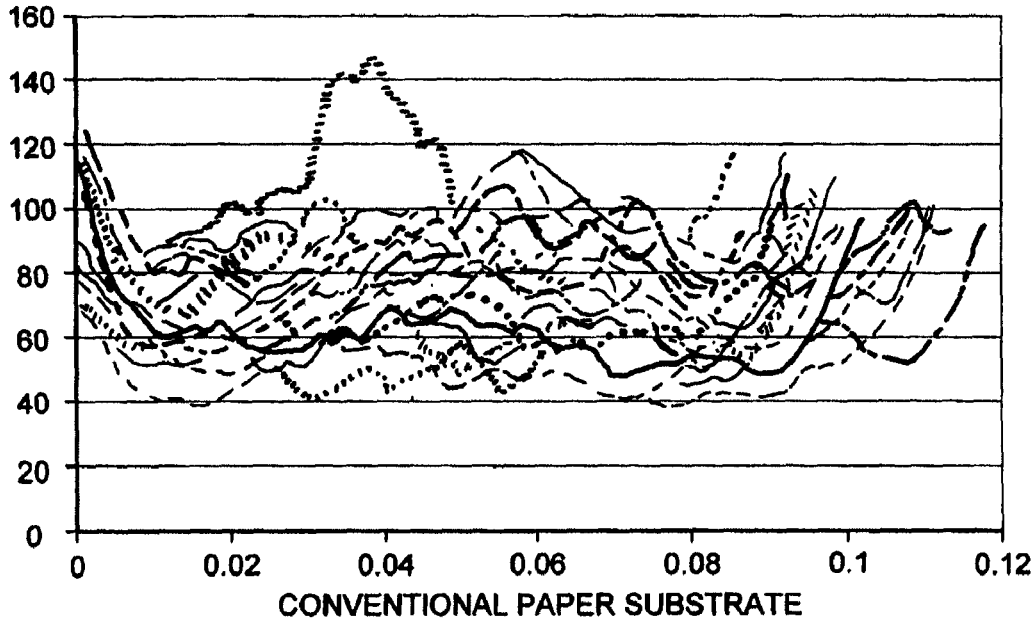
FIG. 7A is a graphical representation of thirty traces measured according to the procedure described in Example 2 on a conventional paper substrate with the left ends of each aligned.
Figure 7B:
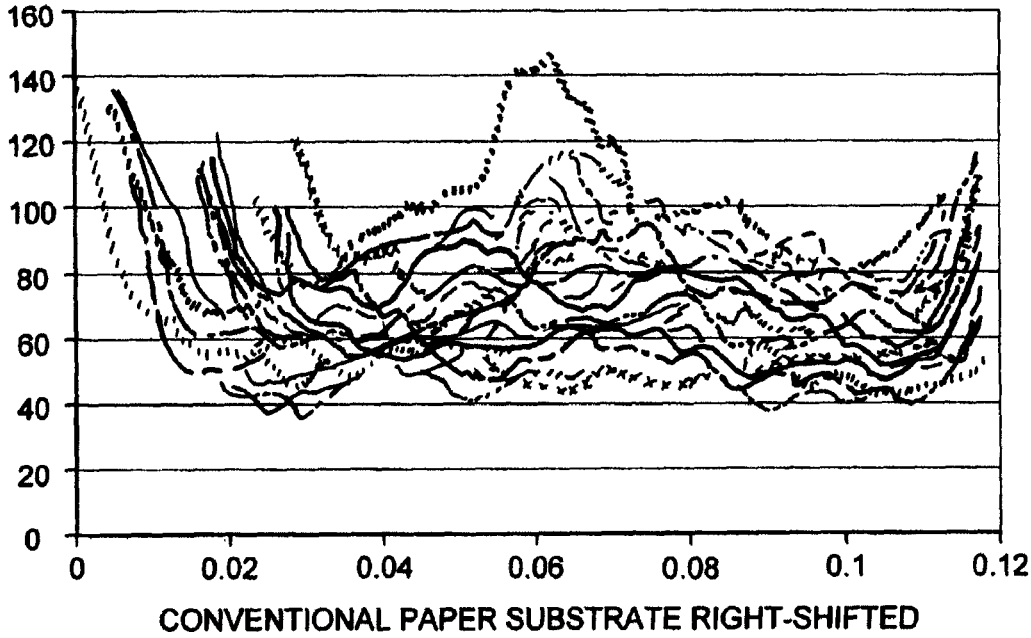
FIG. 7B is a graphical representation of thirty traces measured according to the procedure described in Example 2 on a conventional paper substrate with the right ends of each aligned.
Figure 8A:
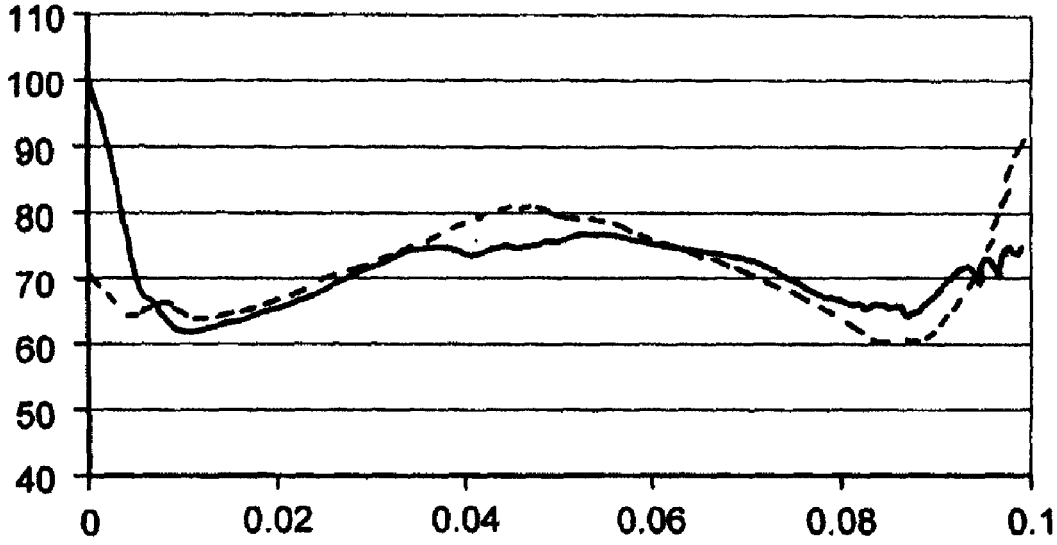
FIG. 8A is a graphical representation of the mean plots according to the procedure described in Example 2 on a conventional paper substrate.
Figure 8B:
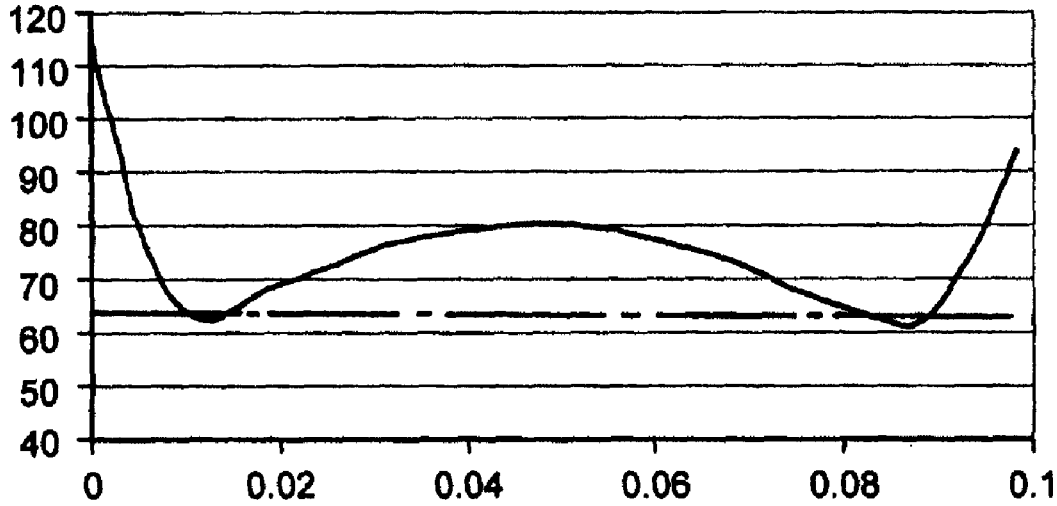
FIG. 8B is a graphical representation of the composite curve including a line drawn between the two minima therein according to the procedure described in Example 2 on a conventional paper substrate.

In FIG. 6C, a line was drawn between the two minima, defining an area of interest in the central region of the graph. The weighted average intensity along the intensity curve between the minima was calculated as 85.84, shown as a black horizontal line on the graph above. Vertical lines from the intersection of the mean brightness and the intensity curve to the baseline (not shown) defined three sub-regions within the area of interest and also the portion of the intensity curve used to calculate the slope. The analysis of this isolated region gave three values: the total area between the intensity curve and the baseline; the slope of the curve at either end; and the ratio of the areas contained in the "tails" to the total area under the curve (a simulated "Q" ratio).

FIGS. 7A, 7B, 8A, and 8B were performed similarly and are representative plots (similar to 5A, 5B, 6A and 6B, respectively), but for conventional paper substrates.

As mentioned above, the slope of each leg of the curve within the interest region was calculated using Excel's trend line function applied between the local minima and a point along the upper curve defined as the weighted average brightness along the curve between the two minima. This slope is representative of the rate at which the starch level decreases as a function of the penetration towards the middle of the cross-section of the sheet. Accordingly, the slope of the line drawn is intensity units/mm (progressing, in mm, across the cross section of the sheet. For left leg (representing the slope at the top side of the sheet), the present invention has a slope that is 1612.9 intensity units/mm while that of for the conventional paper substrate has a slope that is 426.1 intensity units/mm. Accordingly, as you traverse from the top surface of the sheet to the center of the sheet, the paper substrate of the present invention has a much greater rate of disappearance of starch (as measured by slope) and the starch is clearly mostly isolated towards the top surface of the sheet. For right leg (representing the slope at the bottom side of the sheet), the present invention has a slope that is 1408.9 intensity units/mm while that of for the conventional paper substrate has a slope that is 663.46 intensity units/mm. Accordingly, as you traverse from the bottom surface of the sheet to the center of the sheet, the paper substrate of the present invention also has a much greater rate of disappearance of starch (as measured by slope) and the starch is clearly mostly isolated towards the top surface of the sheet.

While these are examples, it is preferable that the paper substrate of the present invention have at least half (top half or bottom half) of its cross section so as to provide a slope (as measured above) that is such that can provide any one of more of the characteristics of the paper substrate of the present invention mentioned above (e.g. Internal Bond, Hygroexpansivity, IGT pick test, and IGT VPP delamination). The slope may be greater than 700 intensity units/mm, preferably greater than 850 intensity units/mm, more preferably greater than 900 intensity units/mm, most preferably more than 1150 intensity units/mm. In a more preferred embodiment, the paper substrate of the present invention both halves (top and bottom halves) of its cross section so as to provide slope (as measured above) that is such that can provide any one of more of the characteristics of the paper substrate of the present invention mentioned above (e.g. Internal Bond, Hygroexpansivity, IGT pick test, and IGT VPP delamination). The slopes may be greater than 700 intensity units/mm, preferably greater than 850 intensity units/mm, more preferably greater than 900 intensity units units/mm, most preferably more than 1150 intensity units/mm.

Example 3

The following Tables 2 and 3 describes 41 paper substrates made under pilot paper machine conditions using a rod-metered size press applied solution containing starch as the sizing agent. The specifics of each condition, e.g. linear speed, size press nip pressure, starch loading, total starch solids, size press solution viscosity, roll P&J harness, etc, etc is described in the tables. The P&J hardness conditions run in this study fell into one of two categories; Category 1: a first roll had a P&J hardness of 35 and as second roll had a P&J hardness of 35; and Category 2: a first roll had a P&J of 35 and as second roll had a P&J of 45. In addition, the resultant performance characteristics and physical properties of the paper substrates are mentioned in the tables, e.g. internal bond, gurley porosity, hygroexpansion, stiffness, TS (top side) IGT pick, BS (bottom side) IGT pick, etc, etc. Internal Bond is shown in two columns, one in ft-lbs$\times 10^{-3}$/in$^2$ (i.e. ft-lbs) and one in J/m$^2$ (i.e. J). These columns are not separate measurements, but rather are provided to exemplify the conversion factors between the two units of measurement for Internal Bond mentioned above.

TABLE 1

| Table 1 Condition | Nip Load/pressure, pll | Starch Loading (gsm) | Total Starch Solids (wt %) | Size press solution Viscosity cP | P & J IF 1 then P/J is 35:35, if 2 then P/J is 35:45 | linear Speed of paper, fpm | Reel Moisture off machine, % | Gurley Porosity (seconds) | CD Stiffness (mgf) | Hygroexpansion (%) |
|---|---|---|---|---|---|---|---|---|---|---|
| 1 | 225 | 3.6 | 15.9 | 264 | 2 | 2802 | 4.9 | 29.65 | 109.6 | 1.22 |
| 2 | 225 | 3.2 | 15.9 | 264 | 2 | 2305 | 5 | 30 | 110.2 | 1.22 |
| 3 | 225 | 2.9 | 15.9 | 264 | 2 | 1806 | 6 | 35.85 | 102.2 | 1.207 |
| 4 | 150 | 3.8 | 15.9 | 264 | 2 | 2802 | 4.6 | 26.1 | 123.6 | 1.127 |
| 5 | 150 | 3.2 | 15.9 | 264 | 2 | 1806 | 4.2 | 25.5 | 119.2 | 1.107 |
| 6 | 150 | 3.8 | 15.9 | 264 | 2 | 2802 | 5.7 | 26.55 | 113.6 | 1.087 |
| 7 | 150 | 3.9 | 15..9 | 264 | 2 | 2801 | 5.6 | 25.45 | 115.8 | 1.093 |
| 8 | 225 | 3.5 | 15.9 | 264 | 2 | 2306 | 4.4 | 23.45 | 121.2 | 1.093 |
| 9 | 225 | 2.8 | 16 | 175 | 2 | 1806 | 5.9 | 24.2 | 112.4 | 1.133 |
| 10 | 150 | 3.2 | 16 | 175 | 2 | 2305 | 4.6 | 22.75 | 112.8 | 1.173 |
| 11 | 225 | 3.6 | 16 | 175 | 2 | 2802 | 4.9 | 21.6 | 122.6 | 1.287 |
| 12 | 150 | 3.7 | 15.65 | 175 | 2 | 2802 | 4.5 | 22.15 | 107 | 1.28 |
| 13 | 150 | 3.3 | 15.65 | 175 | 2 | 1806 | 5.3 | 26.6 | 118.2 | 1.26 |
| 14 | 225 | 3.5 | 15.65 | 175 | 2 | 2305 | 4.8 | 20.9 | 108.4 | 1.26 |
| 15 | 150 | 3.5 | 15.65 | 175 | 2 | 2306 | 4.7 | 22.8 | 108.4 | 1.253 |
| 16 | 225 | 3.4 | 15.65 | 175 | 2 | 1806 | 5.5 | 23.6 | 108.4 | 1.273 |
| 17 | 150 | 3.3 | 15.65 | 175 | 2 | 1806 | 5.6 | 25.1 | 115.6 | 1.273 |
| 18 | 225 | 3 | 9.25 | 65 | 2 | 2105 | 5.3 | 12.35 | 122.2 | 1.18 |
| 19 | 225 | 3.7 | 15.8 | 282 | 1 | 2802 | 5 | 22.55 | 154.6 | 1.2 |
| 20 | 225 | 3.2 | 15.8 | 282 | 1 | 1806 | 4.4 | 28.1 | 116.3 | 1.173 |
| 21 | 225 | 3.4 | 15.15 | 268 | 1 | 2306 | 4.1 | 24.85 | 116 | 1.1 |
| 22 | 150 | 3.6 | 15.15 | 268 | 1 | 2803 | 6.1 | 25.35 | 115 | 1.127 |
| 23 | 150 | 3 | 15.15 | 268 | 1 | 1806 | 4.8 | 29.1 | 118 | 1.107 |
| 24 | 150 | 3.4 | 15.15 | 268 | 1 | 2305 | 4.5 | 24.55 | 114 | 1.113 |
| 25 | 225 | 3.2 | 15.15 | 268 | 1 | 1806 | 5.1 | 28.05 | 112.8 | 1.107 |
| 26 | 150 | 3.9 | 15 | 282 | 1 | 2802 | 5.3 | 23.75 | 133.4 | 1.113 |
| 27 | 150 | 3.3 | 15.8 | 164 | 1 | 2802 | 4.3 | 19.9 | 106.8 | 1.153 |
| 28 | 225 | 3 | 15.8 | 164 | 1 | 1806 | 4.5 | 21.6 | 105.4 | 1.127 |
| 29 | 225 | 3.4 | 15.8 | 164 | 1 | 2802 | 4.4 | 19.55 | 110.4 | 1.133 |
| 30 | 225 | 3.2 | 15.1 | 169 | 1 | 2305 | 3.9 | 18.9 | 96.6 | 1.147 |
| 31 | 150 | 3 | 15.1 | 169 | 1 | 1806 | 4.8 | 23.25 | 102.8 | 1.24 |
| 32 | 150 | 3.3 | 15.1 | 169 | 1 | 2306 | 3.6 | 18.6 | 104.4 | 1.237 |
| 33 | 225 | 3 | 15.1 | 169 | 1 | 1806 | 5.8 | 20.75 | 100.4 | 1.253 |
| 34 | 225 | 3.6 | 15.1 | 169 | 1 | 2802 | 5 | 19.1 | 111.6 | 1.28 |
| 35 | 150 | 3 | 15.2 | 162 | 1 | 1806 | 5.4 | 22.1 | 96.6 | 1.28 |
| 36 | 225 | 2.9 | 9.5 | 57 | 1 | 2104 | 5.8 | 12.45 | 103.2 | 1.207 |
| 37 | 225 | 3.5 | 15.9 | 253 | 2 | 2801 | 4.6 | 21.9 | 113.2 | 1.147 |
| 38 | 150 | 3.2 | 15.9 | 253 | 2 | 2305 | 4.3 | 23 | 111 | 1.12 |
| 39 | 150 | 2.9 | 15.9 | 253 | 2 | 1806 | 5.4 | 26.6 | 110.6 | 1.12 |
| 40 | 225 | 3.2 | 15.9 | 253 | 2 | 2305 | 4.9 | 21.2 | 109.8 | 1.14 |
| 41 | 225 | 2.9 | 15.9 | 253 | 2 | 1806 | 5.7 | 24.6 | 125 | 1.087 |

TABLE 2

| Condition | TS, IGT Blister Speed m/s | TS, IGT VVP Blister N/m | TS, IGT Pick Speed, m/s | TS, IGT VVP Pick, N/m | TS, IGT Delamination, m/s | TS, NGT VVP Delamination, N/m | BS, IGT Blister Speed m/s | BS, IGT VVP Blister N/m | BS, IGT Pick Speed, m/s | BS, IGT VVP Pick, N/m | BS, IGT Delamination, m/s | BS, IGT VVP Delamination, N/m | Internal Bond (ft-lbs | Internal Bond (J) |
|---|---|---|---|---|---|---|---|---|---|---|---|---|---|---|
| 1 | 1.23 | 129 | 1.32 | 139 | 1.73 | 183 | 1 | 106 | 1.09 | 115 | 1.73 | 183 | 72.2 | 144.4 |
| 2 | 1.18 | 124 | 1.36 | 143 | 1.78 | 187 | 1.09 | 115 | 1.18 | 124 | 1.64 | 173 | 70.6 | 141.2 |
| 3 | 1.09 | 115 | 1.23 | 129 | 1.73 | 183 | 1.09 | 115 | 1 | 106 | 1.41 | 148 | 68.2 | 136.4 |
| 4 | 1.05 | 110 | 1.32 | 139 | 1.78 | 187 | 1.09 | 115 | 1.27 | 134 | 1.87 | 197 | 69 | 138 |
| 5 | 1.18 | 124 | 1.41 | 148 | 1.87 | 197 | 1.09 | 115 | 1.27 | 134 | 1.82 | 192 | 79.6 | 159.6 |
| 6 | 1.09 | 115 | 1.18 | 124 | 1.64 | 173 | 1.05 | 110 | 1.16 | 124 | 1.59 | 168 | 62.4 | 124.8 |
| 7 | 1.23 | 129 | 1.32 | 138 | 1.76 | 187 | 1.14 | 120 | 1.27 | 134 | 1.87 | 197 | 67.2 | 134.4 |
| 8 | 1.05 | 110 | 1.23 | 129 | 1.68 | 177 | 1.09 | 115 | 1.18 | 124 | 1.55 | 163 | 67.2 | 134.4 |
| 9 | 1.05 | 110 | 1.09 | 115 | 1.59 | 168 | 0.96 | 101 | 1.05 | 110 | 1.41 | 148 | 66.8 | 133.8 |
| 10 | 1.27 | 134 | 1.54 | 162 | 1.78 | 167 | 1.14 | 120 | 1.32 | 139 | 1.87 | 197 | 66.8 | 133.8 |
| 11 | 1.35 | 163 | 1.41 | 148 | 1.82 | 192 | 1.14 | 120 | 1.32 | 139 | 1.87 | 197 | 77 | 154 |
| 12 | 1.36 | 143 | 1.65 | 163 | 1.87 | 197 | 1.23 | 129 | 1.45 | 153 | 1.87 | 197 | 70.4 | 140.8 |
| 13 | 1.23 | 129 | 1.59 | 168 | 1.91 | 202 | 1.18 | 124 | 1.36 | 143 | 1.87 | 197 | 84.6 | 129.2 |
| 14 | 1.32 | 139 | 1.5 | 158 | 1.62 | 192 | 1.18 | 124 | 1.41 | 148 | 1.62 | 192 | 69 | 138 |
| 15 | 1.36 | 143 | 1.64 | 173 | 1.87 | 197 | 1.14 | 120 | 1.41 | 148 | 1.82 | 192 | 65.4 | 130.8 |
| 16 | 1.16 | 124 | 1.45 | 153 | 1.87 | 197 | 1.23 | 129 | 1.32 | 139 | 1.87 | 197 | 63.6 | 127.2 |
| 17 | 1.14 | 120 | 1.36 | 143 | 1.82 | 192 | 1.09 | 115 | 1.32 | 139 | 1.87 | 197 | 63.6 | 127.2 |
| 18 | 1.14 | 120 | 1 | 106 | 1.36 | 143 | 1.15 | 124 | 1.05110 | 1.5 | 158 | 91.2 | 182.4 | |
| 19 | 1.36 | 143 | 1.5 | 158 | 1.87 | 197 | 1.05 | 110 | 1.09 | 115 | 1.69 | 176 | 71 | 142 |
| 20 | 1.32 | 139 | 1.5 | 158 | 1.82 | 192 | 1.09 | 115 | 1.18 | 124 | 1.64 | 173 | 65.2 | 130.4 |
| 21 | 1.32 | 139 | 1.45 | 153 | 1.91 | 202 | 1.18 | 124 | 1.32 | 139 | 1.69 | 178 | 65.8 | 131.6 |
| 22 | 1.36 | 143 | 1.59 | 168 | 1.91 | 202 | 1.23 | 129 | 1.36 | 143 | 1.82 | 192 | 67.6 | 135.2 |
| 23 | 1.16 | 124 | 1.36 | 143 | 1.78 | 187 | 1.14 | 120 | 1.23 | 1.29 | 1.68 | 178 | 65.6 | 131.2 |
| 24 | 1.14 | 120 | 1.45 | 153 | 1.82 | 192 | 1.14 | 120 | 1.23 | 129 | 1.69 | 178 | 68 | 136 |
| 25 | 1.14 | 120 | 1.23 | 129 | 1.73 | 183 | 1.14 | 120 | 1.18 | 124 | 1.64 | 173 | 66.2 | 132.4 |
| 26 | 1.23 | 129 | 1.32 | 139 | 1.78 | 187 | 1.09 | 115 | 1.16 | 124 | 1.73 | 183 | 70 | 140 |
| 27 | 1.32 | 139 | 1.45 | 153 | 1.82 | 192 | 1.18 | 124 | 1.36 | 143 | 1.87 | 197 | 67.8 | 135.6 |
| 28 | 1.09 | 115 | 1.41 | 148 | 1.87 | 197 | 1.09 | 115 | 1.27 | 134 | 1.69 | 178 | 64.4 | 128.6 |
| 29 | 1.36 | 143 | 1.55 | 153 | 1.82 | 192 | 1.14 | 120 | 1.36 | 143 | 1.91 | 202 | 69.8 | 139.6 |
| 30 | 1.09 | 116 | 1.36 | 143 | 1.87 | 197 | 1.18 | 124 | 1.36 | 143 | 1.78 | 187 | 64.2 | 128.4 |
| 31 | 1.18 | 124 | 1.36 | 143 | 1.82 | 192 | 1.14 | 120 | 1.36 | 143 | 1.87 | 197 | 65.8 | 131.6 |
| 32 | 1.23 | 129 | 1.31 | 138 | 1.82 | 192 | 0.96 | 101 | 1.32 | 139 | 1.64 | 173 | 66.8 | 133.6 |
| 33 | 1.16 | 124 | 1.27 | 134 | 1.69 | 178 | 1.09 | 115 | 1.18 | 124 | 1.59 | 168 | 64.4 | 128.8 |
| 34 | 1.32 | 139 | 1.45 | 153 | 1.87 | 197 | 1.32 | 139 | 1.5 | 158 | 1.91 | 202 | 69.2 | 138.4 |
| 35 | 1.09 | 115 | 1.27 | 134 | 1.73 | 183 | 1.14 | 120 | 1.32 | 139 | 1.62 | 192 | 65.8 | 131.6 |
| 36 | 1.14 | 120 | 0.96 | 101 | 1.41 | 146 | 1.14 | 120 | 1.16 | 124 | 1.41 | 148 | 81.2 | 162.4 |
| 37 | 1.09 | 115 | 1.32 | 139 | 1.73 | 183 | 1.05 | 110 | 1.27 | 134 | 1.75 | 187 | 64.2 | 126.4 |
| 38 | 1.05 | 110 | 1.36 | 143 | 1.69 | 178 | 1 | 108 | 1.32 | 139 | 1.69 | 178 | 63.6 | 127.2 |
| 39 | 1.09 | 115 | 1.23 | 129 | 1.69 | 178 | 1 | 106 | 1.18 | 124 | 1.78 | 187 | 63.4 | 126.8 |
| 40 | 1.09 | 115 | 1.23 | 129 | 1.64 | 173 | 1 | 106 | 1.18 | 124 | 1.73 | 183 | 68.4 | 132.8 |
| 41 | 1 | 106 | 1.09 | 115 | 1.73 | 183 | 1 | 106 | 1.14 | 120 | 1.69 | 176 | 64.6 | 129.2 |

Example 4

In the examples below, the phrase "x-100" refers to the preferred bulking agent discussed above having a particle containing an expandable microsphere and an ionic compound so that the particle has a zeta potential that is greater than or equal to zero mV at a pH of about 9.0 or less at an ionic strength of from $10^{-6}$ M to 0.1M.

Process Conditions

| hardwood/softwood = 60/40 | Control | Trial |
|---|---|---|
| Starch Solids at Size Press, % | 8 | 16 |
| Viscosity, cP | 50 | 200 |
| Rod on Size Press | 35 | SP002 |

Physical Testing

| | Control | Trial | Change, % |
|---|---|---|---|
| Basis Weight | 56.25 | 56.38 | |
| Caliper | 5.01 | 4.91 | |
| Internal Bond, md | 122 | 70 | −42.6 |
| Internal Bond, cd | 117 | 88 | −24.8 |
| G. Porosity, s | 8.7 | 12.4 | 42.5 |
| G. Stiffness, mgf, md | 287 | 301 | 4.9 |
| G. Stiffness, mgf, cd | 109 | 124 | 13.8 |
| Opacity, % | 92.4 | 93.1 | 0.8 |
| Hygroexpansion, from 85RH to 15RH, % | 0.951 | 0.916 | −3.7 |
| Ash Content, % | 14.5 | 14.8 | |
| Starch Content, % | 6.13 | 6.63 | |

Process Conditions

| hardwood/softwood = 60/40 | Control | Trial |
|---|---|---|
| Starch Solids at Size Press, % | 9.4 | 16.5 |
| Viscosity, cP | 50.4 | 204 |
| Rod on Size Press | 004 | SP002 |

Physical Testing

| | Control | Trial | Change, % |
|---|---|---|---|
| Basis Weight | 56.3 | 56.3 | |
| Caliper | 5.18 | 5.14 | |
| Internal Bond, md | 148 | 80 | −45.9 |
| Internal Bond, cd | 147 | 85 | −42.2 |
| G. Porosity, s | 11.4 | 17 | 49.1 |
| G. Stiffness, mgf, md | 309 | 285 | −7.8 |
| G. Stiffness, mgf, cd | 143 | 167 | 16.8 |
| Opacity, % | 91.7 | 91.8 | 0.1 |
| Hygroexpansion, from 85RH to 15RH, % | 1.194 | 1.01 | −15.4 |
| Ash Content, % | 13.47 | 14.03 | |
| Starch Content, % | 5.53 | 6.13 | |

Example 5

In the examples below, the phrase "x-100" refers to the preferred bulking agent or bulking particle discussed above having a particle containing an expandable microsphere and an ionic compound so that the particle has a zeta potential that is greater than or equal to zero mV at a pH of about 9.0 or less at an ionic strength of from $10^{-6}$ M to 0.1M.

Summary of Trial 2 in Example 5: The Addition of X-100

Objectives of this X-100 trial are to study machine runnability, machine cleanliness, and property development, and to confirm offset print performance with a longer run of 18 lb. Hi-Bulk than was done in the Nov. 3, 2005 trial (i.e. Trial 1). Based on results of the first trial, an addition rate of 6.2 lb/T based on furnish pull will be trialed for 4-5 hours while targeting I-beam conditions at the size press. A small part of this trial will be vellum finished; the majority will be calendered to caliper specs for export order. Starting addition rate will be 3.1 lb/T (based on furnish pull; vellum finish) and observations will be made for 30 minutes at this addition rate. Once loading is increased to the target 6.2 lb/T, one set of vellum product will be made before calendering back to spec. This set will be used for more extensive physical testing than was done in the initial trial.

Pre-cationized X-100 (642-SLUX-80) will be added at the primary screen inlet.

Objectives of the trial are:

- Determine bulking efficiency for vellum product at 3.1 lb/T addition rate
- Observe machine response and identify papermaking issues, including charge balance, dryer deposits, sheet defects, shade, and steam demands
- Replicate the 6.2 lb addition rate in the first trial
- Determine caliper and stiffness impact on multiple samples off the winder for 6.2 lb vellum product
- Confirm offset print performance with a longer run (target 9 rolls)

Proposed Trial Conditions are:

Control: Standard 18 lb. High Bulk (vellum)

Condition 1: 3.1 lb/ton X-100; vellum calendering

Condition 2: 6.2 lb/ton X-100; vellum calendaring

Condition 3: 6.2 lb/ton X-100; calendered to 4.0 caliper

Background of Trial 1 in Example 5: The Addition of X-100

This trial was done in conjunction with elevated starch solids and starch pickup at the size press. Two levels of X-100 were trialed: 6.2 lb/ton and 12.0 lb/ton, with both addition rates based on tons of furnish pull (corresponding addition rates based on gross reel production were 4.6 and 9.0 lb/ton, respectively). X-100 material used in this trial was cationized at Western Michigan University using high molecular weight PEI.

Gauging system caliper trends showed a rapid and robust response. On-line caliper increased from 4.0 to 4.2 at the lower addition rate, and from 4.2 to 4.3 at the higher addition rate, corresponding to bulk gains of 5-7%. Mill stiffness values did not show a clear and consistent stiffness improvement (due in part to scatter in the few data available), but testing of roll products and reel strip analysis suggested stiffness gains of 6-7% CD and up to 15% MD. Gurley porosity did not change with the X-100 addition, due in large part to the high starch solids and pickup.

Machine cleanliness issues were far less than expected in this short trial, with the only known issue being flakes of agglomerated X-100 seen falling into the basement as the trial progressed. In addition, there was some very slight discoloration of No. 6 Dryer, but not to the level of requiring cleaning after the trial ended. No buildup on any other machine surfaces was observed.

Main section steam pressures increased throughout the trial to maximum values, and even then, size press moistures were above target. Production runs may well have to be slowed back due to main section drying issues.

Control and trial products have been flexo printed, offset printed, and EP printed. With all print formats, both trial products exhibited very similar print quality and cut-size performance as the 18 lb. Hi-Bulk control product.

Trial 2 Outline of Example 5

The 642-SLUX-80 (X-100) slurry remaining from a previous trial will be used for this trial (product was previously cationized at Western Michigan University).

Main section dryer can head temperatures will be measured prior to or during the trial via IR.

No changes in retention aid or PAC are planned for this trial.

Lead-in grade will be standard 18 lb. vellum HB. Once this reel turns up, X-100 will be added at the Primary Screen inlet at 3.1 lb/Ton based on stock flow. A static mixer will be used along with mill water to reduce slurry solids prior to injection. Headbox and white water samples will be collected for first pass and ash retention once the machine is stable. Once this (vellum) set is made, X-100 will be increased to 6.2 lb/T for Condition 2 (one stable reel at vellum finish). Calendering will then be increased to get within calendar spec.

Slurry Description of Example 5

Active solids of the cationized slurry is 30%. This material will be metered into the thin stock system on the machine using a variable-speed Moyno pump. Addition rates and volume requirements can be estimated from Tables 6 & 7 below.

TABLE 1

C35 Dosage Calculations 250 gallon totes
Assumptions and Dosage Calculations

| | |
|---|---|
| 3,400 | fpm |
| 356 | reel trim |
| 18 | reel weight |
| 4.50% | lb moisture |
| 4.25% | lb starch |
| 16.5% | filler |
| 13.46 | Approx. BD weight w/o starch or filler |
| 31.32 | Approximate TPH furnish throughput (FPR excluded from calcs) |
| 1,044 | lb/min furnish throughput |
| 0.522 | ton/min furnish throughput (752 TPD) |

| | Neat | Dilute |
|---|---|---|
| Solids | 44% | 22% |
| S.G. | 1.2 | 1.02 |

Courtland 35 X-100 Trial: Dec. 13, 2005

| see NOTE X-100 Load, lb/ton | Neat gpm | Dilute gpm | Dilute Pump Speed | Run Hours per Dil. Tote |
|---|---|---|---|---|
| 3.1 | 0.36 | 0.85 | 25.9 | 4.89 |
| 6.2 | 0.72 | 1.70 | 48.8 | 2.44 |

NOTE:

lb/ton load calculated on furnish throughput (as in previous trials). At 100% retention, load in finished product will be 25.3% less

TABLE 2

Estimated Trial Time and Slurry Consumption

| Cond'n | X-100 Loading (lb/T) Based on Furnish | Based on Reel TPH | Machine Hours | Gallons |
|---|---|---|---|---|
| Control | 0.0 | 0 | N/A | 0 |
| 1 | 3.1 | 2.3 | 0.50 | 26 |
| 2 | 6.2 | 4.6 | 4.50 | 460 |
| | | Totals: | 5.0 | 486 |

Addition Point of X-100

Figure 9:
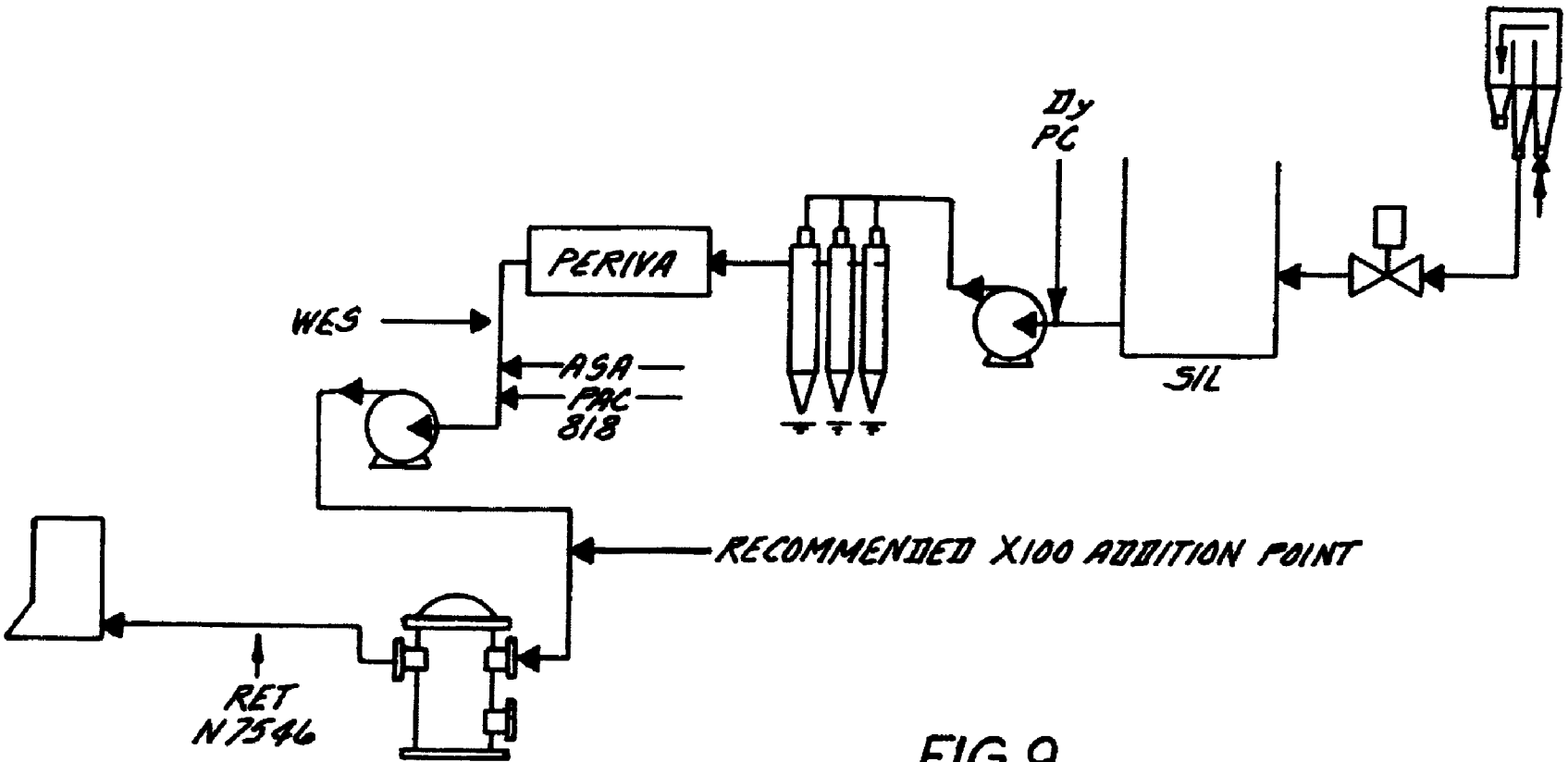
FIG. 9 is a diagrammatic representation of the recommended addition point of the bulking agent according to the process described in Example 5.
Figure 10A:
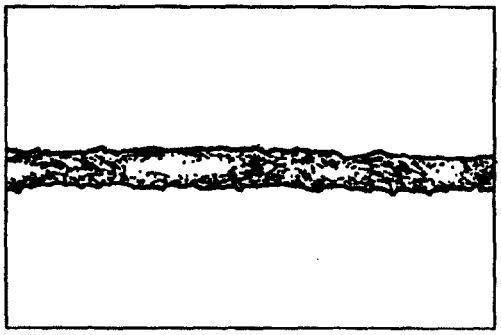
FIG. 10A is a micrograph at 10× magnification of a representative cross section of a paper substrate made under the 2$^{nd}$ Control conditions of Trial 2 according to Example 5.
Figure 10B:
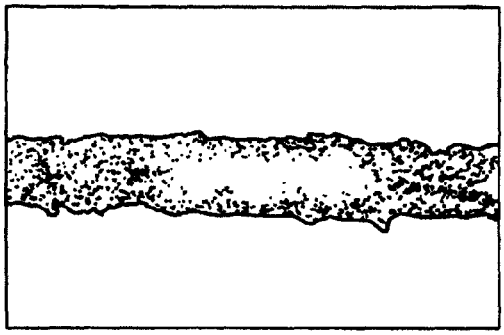
FIG. 10B is a micrograph at 20× magnification of a representative cross section of a paper substrate made under the 2$^{nd}$ Control conditions of Trial 2 according to Example 5.
Figure 10C:
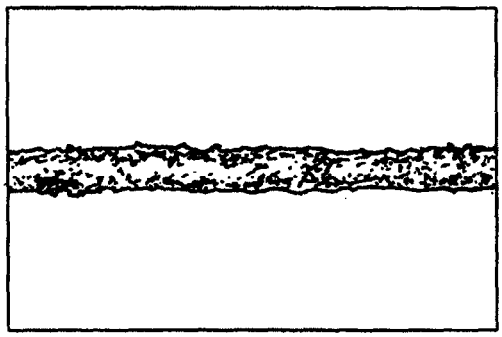
FIG. 10C is a micrograph at 10× magnification of a representative cross section of a paper substrate made under the Condition 1 of Trial 2 according to Example 5.
Figure 10D:
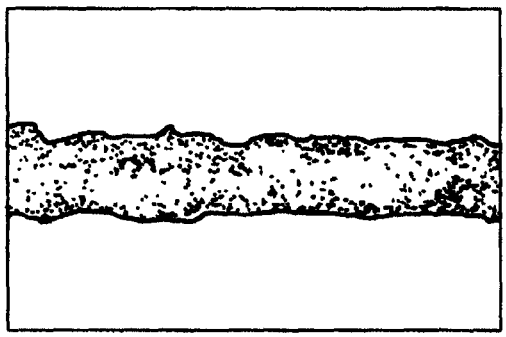
FIG. 10D is a micrograph at 20× magnification of a representative cross section of a paper substrate made under the Condition 1 of Trial 2 according to Example 5.
Figure 10E:
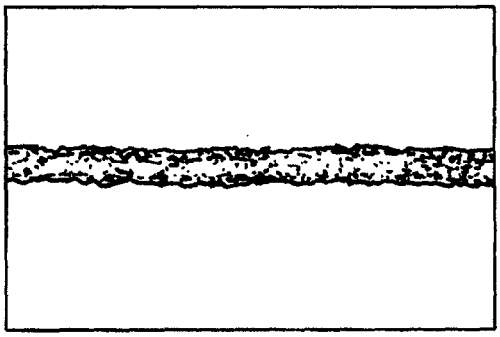
FIG. 10E is a micrograph at 10× magnification of a representative cross section of a paper substrate made under the Condition 2 of Trial 2 according to Example 5.
Figure 10F:
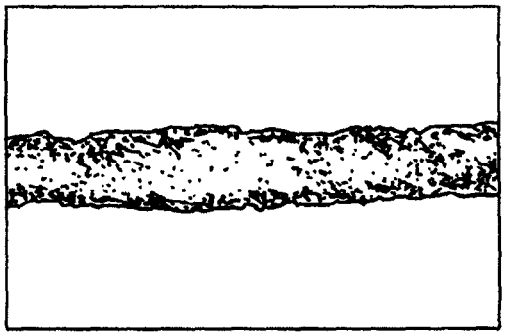
FIG. 10F is a micrograph at 20× magnification of a representative cross section of a paper substrate made under the Condition 2 of Trial 2 according to Example 5.

From earlier review of the wet end, the best addition point for this trial is at the Primary Screen feed (FIG. 9). Cationized X-100 will be further diluted from the nominal 30% to a range of 0.3% to 3.0% using mill water and a static mixer. This approach was used successfully previously with thin stock addition at addition rates of 1.4 to 9.9 lb/Ton.

Sampling

Control: 3 reel strips

Condition 1 (3.1 lb/T Vellum): 3 reel strips

Condition 2 (6.2 lb/T Vellum): 3 reel strips 6 cut-size samples from each roll off winder (with machine edge)

Mill Testing

All trial conditions, including the control condition, should undergo a full battery of QC tests and results entered into the Proficy system. In addition, each reel of 18 lb Hi-Bulk in this cycle should be tested for stiffness.

Downtime

All trial time, from the start of the transition to the control condition (if machine is not on 18 lb. HB) until the machine resumes normal production, should be charged as downtime in the PPR (code XXX—scheduled/idle/market conditions). Any downtime due to breaks during the trial and/or machine cleanup should also be included in the downtime.

The samples of Trial 2 were cross sectioned using a razor-blade and stained with iodine. The samples were them imaged after approximately ten minutes. FIGS. 10A-10F show the results of optical microscopic analysis of starch penetration at 10× and 20× magnification.

PDC LIMS: Reel Strip Analysis
C35 X-100 Trial 1
Reel Strips Evaluated

| Reel | Cond'n | T/U | X-100* (bulking particle) | Calender Load |
|---|---|---|---|---|
| 5L0305 | 1st Control | 10:15 | None | Vellum (40 PLI) |
| 5L0309 | 2nd Control | 13:23 | None | Vellum (40 PLI) |
| 5L0310 | Cond. 1 | 14:14 | 6.2 lb/T | Vellum (40 PLI) |
| 5L0311 | Cond. 2 | 14:58 | 12 lb/T | Vellum (40 PLI) |
| | Calendered | | 12 lb/T | 125 PLI |
| | Calendered | | 12 lb/T | 200 PLI |

*X-100 loading based on fiber pull to machine

| PDC LIMS: Reel Strip Caliper Summary C35 X-100 Trial 1 | | | | | | |
|---|---|---|---|---|---|---|
| | 5L0305 | 5L0309 | 5L0310 | 5L0311 | 125 PLI | 200 PLI |
| X-100 = | 0 | 0 | 6.2 | 12 | 12 | 12 |
| N = | 59 | 59 | 58 | 58 | 59 | 59 |
| Avg = | 4.17 | 4.21 | 4.41 | 4.45 | 4.24 | 4.10 |
| S.D. = | 0.05 | 0.05 | 0.05 | 0.06 | 0.14 | 0.06 |
| Min = | 4.01 | 4.08 | 4.31 | 4.32 | 3.87 | 3.95 |
| Max = | 4.29 | 4.31 | 4.54 | 4.57 | 4.49 | 4.19 |
| Range = | 0.27 | 0.23 | 0.23 | 0.25 | 0.62 | 0.24 |

Caliper measured at 6" intervals

| PDC LIMS: Reel Strip Summary C35 X-100 Trial 1 | | | | | | |
|---|---|---|---|---|---|---|
| | 5L0305 | 5L0309 | 5L0310 | 5L0311 | 125 PLI | 200 PLI |
| X-100 lb/T | 0 | 0 | 6.2 | 12 | 12 | 12 |
| Calender PLI | 40 | 40 | 40 | 40 | 125 | 200 |
| lbs per 1300 sq ft B.W. (2 × 5) | 18.6/0.1 | 18.4/0.1 | 18.7/0.1 | 18.5/0.2 | 18.4/0.3 | 18.5/0.1 |
| mil Caliper (59 × 5) | 4.17/.05 | 4.21/.05 | 4.41/.05 | 4.45/.06 | 4.24/.14 | 4.10/.06 |
| App. Density | 4.45 | 4.37 | 4.24 | 4.15 | 4.33 | 4.52 |
| Bulk Change | | | +4.1% | +6.4% | +1.8% | −2.3% |
| Porosity (5 × 5) | 16.2/1.6 | 16.0/1.5 | 15.1/1.5 | 14.6/1.4 | 15.8/2.2 | 17.6/2.3 |
| MD Stiff (5 × 5) | 134/12 | 129/11 | 149/10 | 155/19 | 129/9 | 136/9 |
| CD Stiff (5 × 5) | 56.7/4.1 | 53.5/5.4 | 58.9/6.0 | 58.9/11 | 57.4/9.1 | 57.5/6.6 |
| WS Smooth (5 × 10) | 241/20 | 243/14 | 261/17 | 260/18 | 225/16 | 222/17 |
| FS Smooth (5 × 10) | 280/19 | 280/15 | 297/18 | 294/21 | 262/17 | 190/13 |
| Scott Bond | | | | | | |

*Basis weight is in lbs/1300 square feet

*Caliper is in mil

Figure 11:
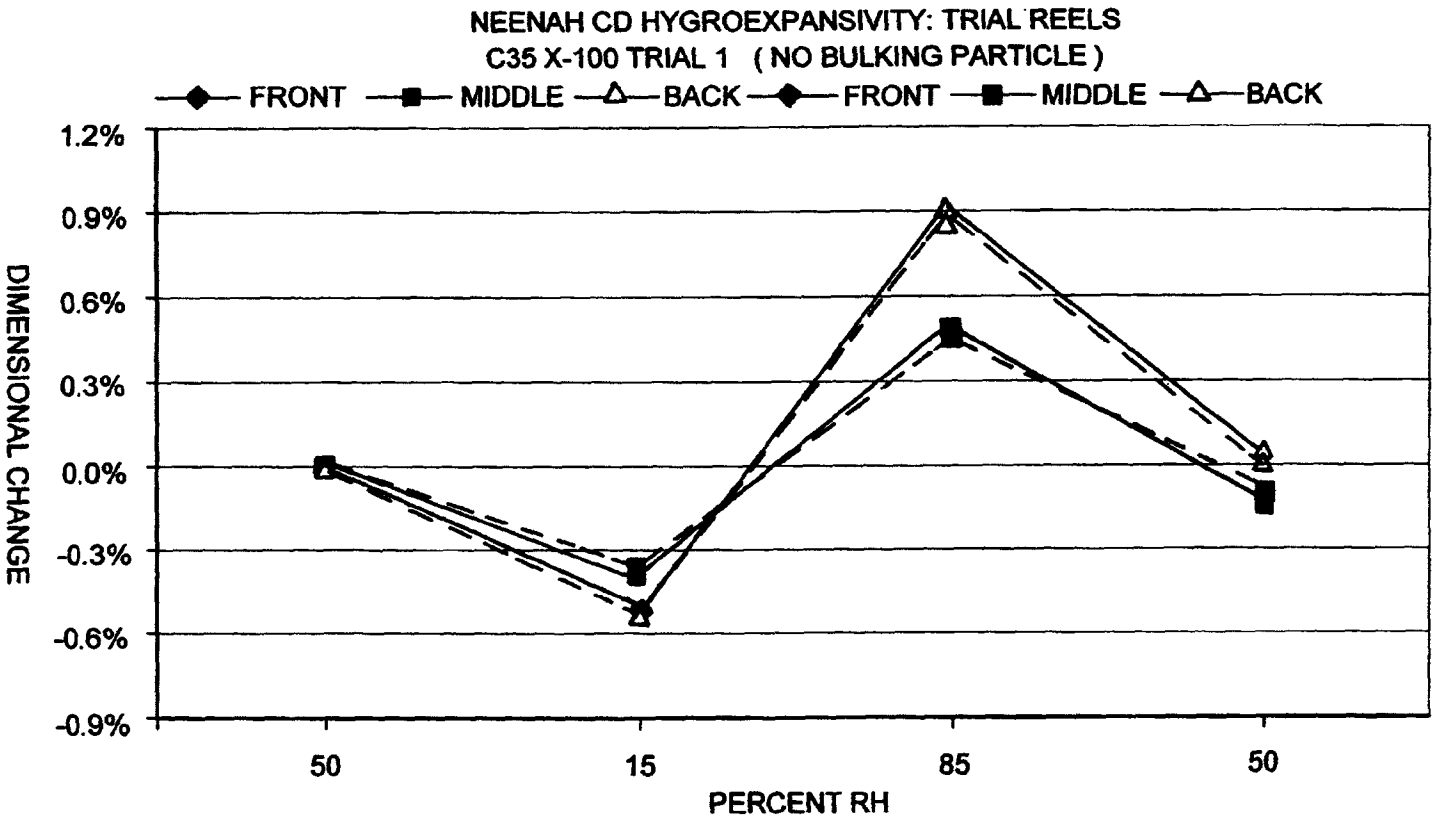
FIG. 11 is a graphical representation of Neenah CD hygroexpansivity of the control reels containing no bulking particle from Trial 1 of Example 5.

FIG. 11 is a graphical representation of Neenah CD hygroexpansivity of the control reels containing no bulking particle from Trial 1 of Example 5.

Figure 12:
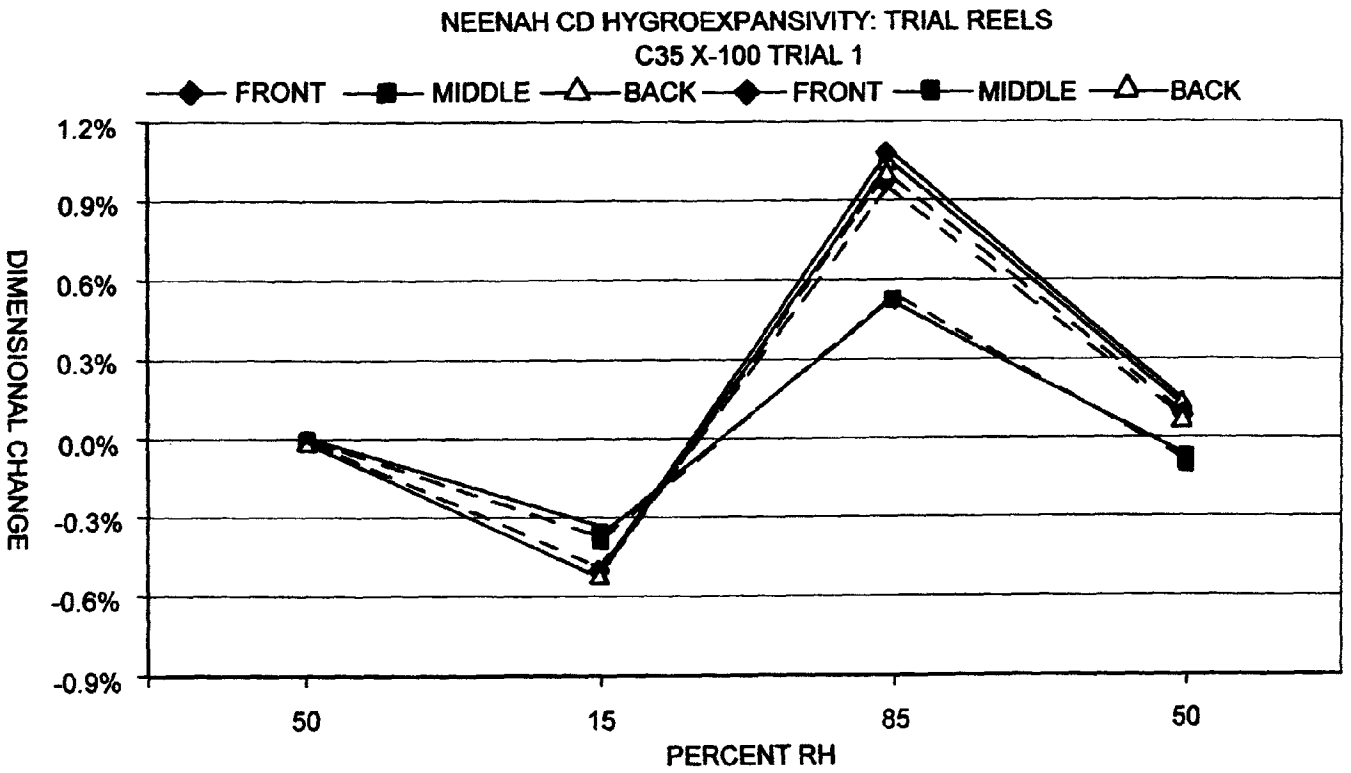
FIG. 12 is a graphical representation of Neenah CD hygroexpansivity of the reels of the control (no bulking particle) and the trial conditions containing 6 lb/T bulking particle from Trial 1 of Example 5.

FIG. 12 is a graphical representation of Neenah CD hygroexpansivity of the reels of the control (no bulking particle) and the trial conditions containing 6 lb/T bulking particle from Trial 1 of Example 5.

Figure 13:
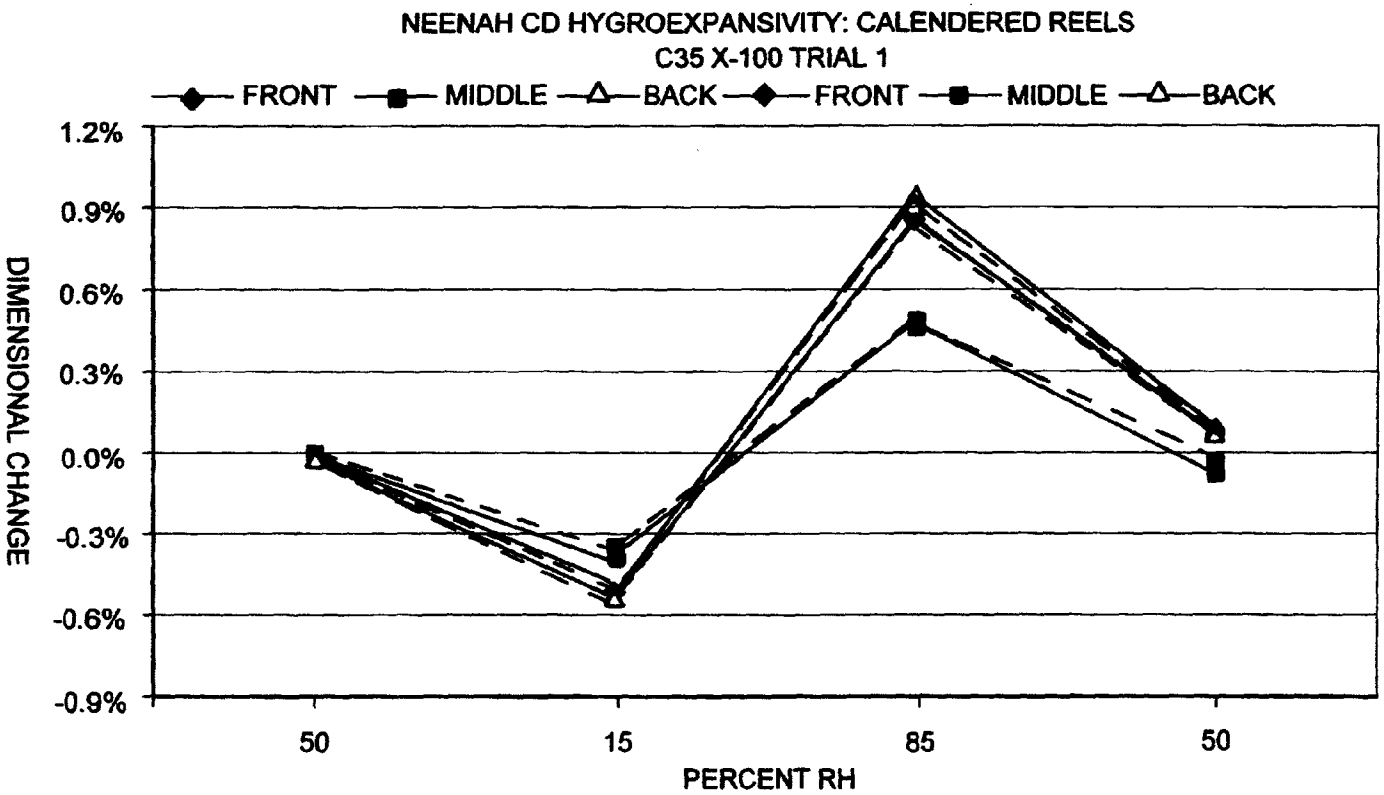
FIG. 13 is a graphical representation of Neenah CD hygroexpansivity of the calendared trial conditions containing 12 lb/T bulking particle from Trial 1 of Example 5.

FIG. 13 is a graphical representation of Neenah CD hygroexpansivity of the calendared trial conditions containing 12 lb/T bulking particle from Trial 1 of Example 5.

| Physical Property Summary: Trial 2 | | | | |
|---|---|---|---|---|
| | Control | Trial | Trial | Trial |
| Reel No. | 1304 | 1305 | 1306 | 1307/8 |
| X-100 | None | 3.2 lb | 6 lb | 6 lb |
| Finish | Vellum | Vellum | Vellum | Calendered |
| Basis Weight | 18.3 | 18.4 | 18.6 | 18.5 |
| Percent Ash | 16.2 | 15.8 | 16.1 | 16.1 |
| Percent Starch | 7.2 | 7.5 | 6.9 | 7.2 |
| Caliper | 4.09 | 4.20 | 4.31 | 4.14 |
| Opacity | 87.8 | 88.3 | 88.1 | 88.3 |
| Gurley Porosity | 18.4 | 17.6 | 16.2 | 16.0 |
| CD Gurley Stiffness | 57.0 | | 56.2 | 54.8 |
| MD Gurley Stiffness | 146 | | 144 | 137 |
| Avg. Internal Bond | 166 | 153 | 156 | 156 |

Example 6

We obtained 40" wide rolls, 50" diameter, mill product. These were made with 40% groundwood pulp, combined with 60% kraft pine. The basis weight was 17.5 lb/1300 ft2.

The paper was shipped to a pilot coater press. We operated it as a rod metering size press. We applied one level of starch coating on the paper, averaging 8% or 160 lb/ton of starch pickup. This starch was applied at high viscosity, above 200 cP, at 150 deg F. The starch used was Cargill 235D Oxidized starch. The size press was run at 500 fpm. The resulting paper was dried to 5% moisture, and calendered for a smoother finish. The paper was then shipped for offset print testing. Sheeted samples were obtained for physical testing.

The results indicated that we obtained good performance and Q values according to the present invention. The surface strength was significantly improved, from an IGT WP Delamination value of 64 to 190 N/m. The two rolls printed cleanly, using high tack inks, which was unexpected. Wood containing paper, for example, Abitibi Equal Offset which is conventional paper, normally needs severe washups within a two to three thousand linear feet. We ran more than 20,000 linear feet, with no washups.

| | Raw Stock - Roll 2 | Raw Stock - Roll 3 | Coated - Roll 2 | Coated - Roll 3 |
|---|---|---|---|---|
| Basis Wt., lb/1300 ft2 | 17.4 | 17.6 | 19.2 | 19.1 |
| Caliper, mils | 4.22 | 4.11 | 3.82 | 3.55 |
| Sheff. Smoothness, TS | 238 | 201 | 152 | 112 |
| Sheff. Smoothness, BS | 223 | 192 | 147 | 105 |
| Gurley Porosity, % | 49 | 50.9 | 776.8 | 916.2 |
| Brightness, TS, % | 71.5 | 71.5 | 69 | 68 |
| Brightness, BS, % | 71.2 | 72.1 | 68.5 | 68.7 |
| Opacity, % | 92.6 | 92.3 | 91.4 | 91.5 |
| MD Stiffness, mg | 93 | 99 | 113 | 107 |
| CD stiffness, mg | 29 | 35 | 41 | 35 |
| IGT Delam, VVP N/m TS | 68 | 55 | 197 | 178 |
| IGT Delam, VVP N/m BS | 62 | 62 | 183 | 202 |
| Wax Pick, TS | 10 | 10 | 14 | 13 |
| Wax Pick, BS | 13 | 13 | 16 | 14 |
| Ash, 525, % | 15.8 | 16.21 | 15.06 | 15.07 |
| Starch, % | 0.93 | 0.9 | 8.2 | 7.7 |

What is claimed is:

1. A paper substrate, comprising a plurality of cellulose fibers;

and a sizing agent; wherein the paper substrate has a hygroexpansivity of from 0.6 to 1.5%, a CD Internal Scott Bond of not more than 300 $J/m^2$ and/or an MD Internal Scott Bond of not more than 300 $J/m^2$.

2. The paper substrate according to claim 1, wherein the paper substrate has a hygroexpansivity of from 0.6 to 1.25.

3. The paper substrate according to claim 1, further comprising from 0.25 to 10 gsm of a sizing agent; wherein the paper substrate has a hygroexpansivity of from 0.6 to 1.25.

4. The paper substrate according to claim 1, further comprising from 0.25 to 10 gsm of a sizing agent; wherein the paper substrate has an Internal Bond/sizing agent ratio that is less than 100 $J/m^2$/gsm and a hygroexpansivity of from 0.6 to 1.25%.

5. The paper substrate according to claim 4, wherein an Internal Bond/sizing agent ratio is less than or equal to 80 $J/m^2$/gsm.

6. The paper substrate according to claim 4, wherein an Internal Bond/sizing agent ratio is less than or equal to 60 $J/m^2$/gsm.

7. The paper substrate according to claim 4, wherein an Internal Bond/sizing agent ratio is less than or equal to 40 $J/m^2$/gsm.

8. A method of making the paper substrate of claim 1, comprising contacting a solution containing a sizing agent with a plurality of cellulosic fibers, wherein the solution has a solids content that is at least 12 wt % solids sizing agent and has a viscosity that is from 100 to 500 centipoise using a Brookfield Viscometer, number 2 spindle, at 100 rpm and 150° F.

9. The method according to claim 8, wherein the solution has a viscosity of from 150 to 300 centipoise.

10. The method according to claim 9, wherein the solution contains a sizing agent solids content that is at least 15 wt %.

11. The method according to claim 8, wherein the solution comprises from 0.25 to 10 gsm of the sizing agent.

12. The paper substrate according to claim 1, wherein the paper substrate has an Internal Bond/sizing agent ratio that is less than 100 $J/m^2$/gsm and a hygroexpansivity of from 0.6 to 1.25%.

13. The paper substrate according to claim 1, wherein the paper substrate has an Internal Bond/sizing agent ratio that is less than 60 $J/m^2$/gsm and a hygroexpansivity of from 0.6 to 1.25%.

14. The paper substrate according to claim 1, wherein the paper substrate has an Internal Bond/sizing agent ratio that is less than 40 $J/m^2$/gsm and a hygroexpansivity of from 0.6 to 1.25%.

15. The paper substrate according to claim 1, wherein the substrate has an IGT pick that is at least 1.

16. The paper substrate according to claim 1, wherein the substrate has an IGT pick that is at least 1.25.

17. The paper substrate according to claim 1, wherein the substrate has an IGT pick that is at least 1.5.

18. The paper substrate according to claim 1, wherein the substrate has an IGT pick that is greater than 1.7.

19. The paper substrate according to claim 1, wherein the substrate contains greater than 4 gsm of sizing agent.

20. The paper substrate according to claim 1, wherein the substrate contains greater than 3.5 gsm of sizing agent.

21. The paper substrate according to claim 1, wherein the substrate contains greater than 4.5 gsm of sizing agent.

* * * * *